US006709193B1

(12) United States Patent
Rogers et al.

(10) Patent No.: US 6,709,193 B1
(45) Date of Patent: Mar. 23, 2004

(54) TEMPORARY RAISED PAVEMENT MARKER (TRPM) APPLICATOR MACHINE FOR AUTOMATICALLY APPLYING PAVEMENT MARKERS TO ROAD SURFACES

(75) Inventors: Jeffrey Rogers, Alexandria, MN (US); Michael Christensen, Parkers Prairie, MN (US); John Kirckof, Glenwood, MN (US); Jeffrey Arnold Wilkens, Reiles Acres, ND (US); Brad Anderson, Alexandria, MN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/247,436

(22) Filed: Sep. 20, 2002

(51) Int. Cl.[7] ..... E01C 23/16
(52) U.S. Cl. ..... 404/94; 404/73; 404/12
(58) Field of Search ..... 404/72, 73, 12–14, 404/15, 93, 94, 84.05

(56) References Cited

U.S. PATENT DOCUMENTS

| | | | | |
|---|---|---|---|---|
| 1,766,073 A | | 6/1930 | Hartzler et al. | |
| 1,833,124 A | | 11/1931 | Rand | |
| 3,380,428 A | | 4/1968 | Abrams | |
| 3,590,701 A | * | 7/1971 | Ten Broeck | 404/84.05 |
| 3,963,362 A | | 6/1976 | Hollis | |
| 4,111,581 A | | 9/1978 | Auriemma | |
| 4,136,991 A | * | 1/1979 | Clark et al. | 404/73 |
| 4,445,803 A | | 5/1984 | Dixon | |
| 4,521,129 A | | 6/1985 | Krech et al. | |
| 4,534,673 A | | 8/1985 | May | |
| 4,542,709 A | | 9/1985 | Spaugh | |
| 4,645,168 A | | 2/1987 | Beard | |
| 4,792,259 A | * | 12/1988 | Eigenmann | 404/73 |
| 4,991,994 A | | 2/1991 | Edouart | |
| 5,327,850 A | | 7/1994 | Sly et al. | |
| 5,392,728 A | | 2/1995 | Speer et al. | |
| 5,393,166 A | | 2/1995 | Stock et al. | |
| 5,460,115 A | | 10/1995 | Speer et al. | |
| 5,515,807 A | | 5/1996 | Speer et al. | |
| 5,788,405 A | | 8/1998 | Beard | |
| 5,853,263 A | * | 12/1998 | Green | 404/94 |
| 5,934,822 A | * | 8/1999 | Green | 404/94 |
| 6,109,820 A | | 8/2000 | Hughes, Sr. | |

FOREIGN PATENT DOCUMENTS

| | | | | |
|---|---|---|---|---|
| FR | 2597521 A1 | * | 10/1987 | B05B/9/00 |
| WO | WO95/2731 | | 1/1995 | |

* cited by examiner

*Primary Examiner*—Thomas B. Will
*Assistant Examiner*—Alexandra K. Pechhold
(74) *Attorney, Agent, or Firm*—Schwartz & Weinrieb

(57) ABSTRACT

Apparatus and method for applying temporary raised pavement markers (TRPM) to roadway surfaces comprises primary and auxiliary conveyors wherein an upstream end portion of the primary conveyor is able to extend, for example, over the rear bed portion of a roadwork truck so as to permit an operator, stationed upon the bed portion of the truck, to deposit pavement markers upon the primary conveyor. In accordance with a first embodiment of the invention, a slide mechanism is disposed adjacent to a downstream end portion of the primary conveyor and adjacent to an upstream end portion of the auxiliary conveyor for transferring pavement markers from the primary conveyor to the auxiliary conveyor when the absence of a pavement marker upon the auxiliary conveyor is detected. When pavement markers are present upon both conveyors, the pavement markers are conducted to applicator mechanisms for application to the roadway surface. A second embodiment of the invention comprises the use of a pair of wheel applicators for applying the temporary raised pavement markers (TRPMS) to the roadway surfaces.

29 Claims, 13 Drawing Sheets

FIG. 4
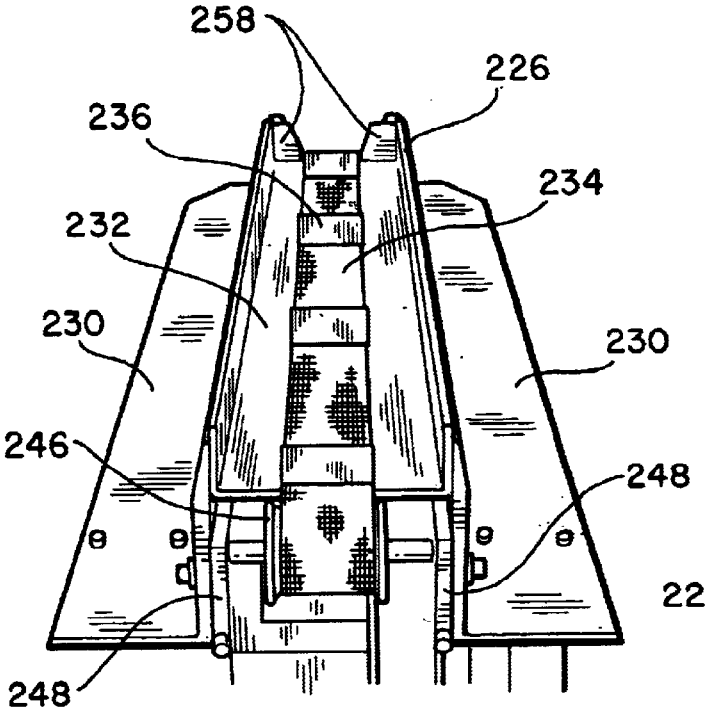
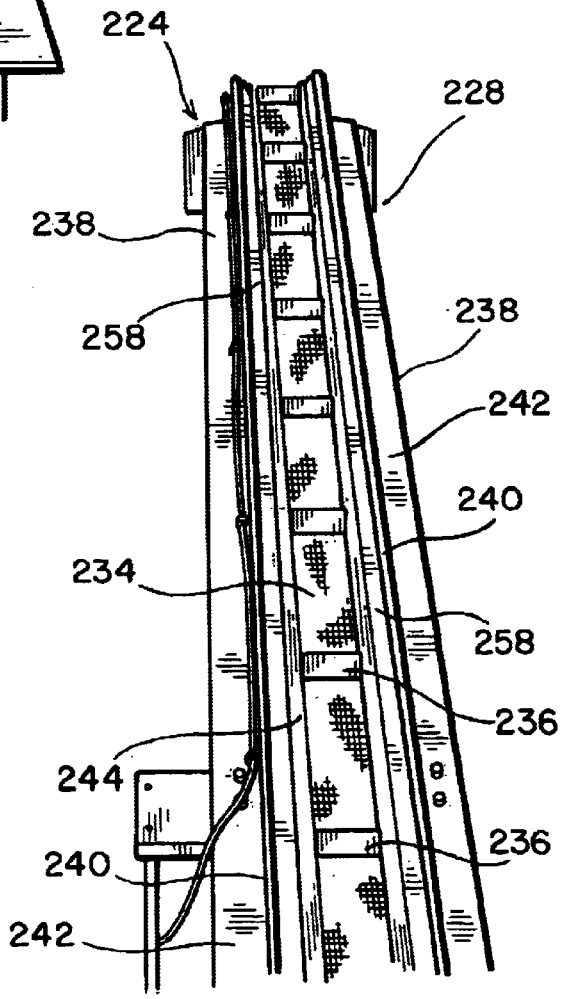
FIG. 5

TEMPORARY RAISED PAVEMENT MARKER (TRPM) APPLICATOR MACHINE FOR AUTOMATICALLY APPLYING PAVEMENT MARKERS TO ROAD SURFACES

FIELD OF THE INVENTION

The present invention relates generally to temporary raised pavement markers (TRPMs) which are adapted to be fixedly secured to roadway surfaces in order to, for example, temporarily define traffic lanes or the like within construction zones, work sites, or maintenance or repair areas, and more particularly to a new and improved machine for automatically applying such temporary raised pavement markers (TRPMs) to the roadway surfaces within such construction zones, work sites, or maintenance or repair areas.

BACKGROUND OF THE INVENTION

Various types of roadway markers have been utilized in connection with a variety of traffic control applications. Many roadway markers are adapted to be permanently attached or secured to the road surface so as to permanently delineate traffic lanes upon the roadway, while other roadway markers are adapted to be temporarily attached or secured to particular road surfaces in order to temporarily delineate traffic lanes within construction zones or other work areas. Accordingly, the latter type of roadway markers are known as temporary roadway markers and are usually attached or secured to the road surface by means of a suitable adhesive that can retain the roadway marker in its place upon the road surface during the temporary life of the roadway marker. More particularly, temporary roadway markers can serve, for example, as a means for identifying edge portions of the roadway, or alternatively, to delineate traffic lane lines and thereby demarcate separate lanes of traffic from each other in and around construction sites and other work zones. After the construction or other road work is completed, the temporary roadway markers are to be removed.

To be effective, the temporary roadway markers must clearly be capable of alerting motorists to the fact that they are nearing or entering a construction zone or work area, and therefore, the temporary roadway markers must in fact be effective both during daytime hours, nighttime hours, sunny conditions, cloudy conditions, inclement weather conditions, and the like. More particularly, one type of temporary roadway marker that has been extremely successful or effective in providing short-term temporary markings upon roadways both during daytime and nighttime hours, and which has also been able to adequately withstand the various impact forces that are normally impressed thereon by daily roadway vehicular traffic so as to in fact provide the desired service life required in connection with the installation of such temporary roadway markers, has been that type of temporary roadway marker which is known in the industry as a temporary raised pavement marker (TRPM). Examples of such temporary raised pavement markers (TRPMs) are disclosed, for example, within U.S. Pat. No. 6,109,820 which issued to Hughes, Sr. on Aug. 29, 2000, U.S. Pat. No. 5,788,405 which issued to Beard on Aug. 4, 1998, U.S. Pat. Nos. 5,460,115 which issued to Speer et al. on Oct. 24, 1995, U.S. Pat. No. 4,991,994 which issued to Edouart on Feb. 12, 1991, and U.S. Pat. No. 4,445,803 which issued to Dixon on May 1, 1984.

As can readily be appreciated from FIG. 1, which corresponds substantially to FIG. 1 of the Speer et al. patent, it is briefly noted that an exemplary temporary raised pavement marker (TRPM) 10 is seen to have a substantially L-shaped configuration wherein the horizontally disposed leg portion 12 thereof is adapted to be fixedly secured or attached to the road surface by means of a suitable adhesive which is allowed to set, while the vertically upstanding leg portion 14 is adapted to be visually seen by the oncoming motorist. A transition region 26 flexibly interconnects the vertically upstanding leg portion 14 to the fixed leg portion or base member 12. A pair of rib members or ledges 28,28 extend substantially perpendicular to the upstanding leg member 14 and serve to define a space or channel 22 therebetween. A suitable reflective strip 23 is adapted to be fixedly disposed within the space or channel 22 so as to reflect sunlight or a vehicle's lights in order to provide the oncoming motorist, as indicated by the arrow 25, with a visual indication that the motorist is approaching or entering a construction zone or work area. Alternatively, in lieu of the reflective strip 23, the entire marker 10 may simply be brightly colored so as to similarly provide the oncoming motorist with the necessary visual warning.

With reference being further made to FIG. 2, a temporary raised pavement marker (TRPM), which is similar to the temporary raised pavement marker (TRPM) 10 disclosed in FIG. 1 of the present drawings as well as within FIG. 1 of the Speer et al. patent, is disclosed at 110 and is seen to likewise have a substantially L-shaped configuration. In particular, the temporary raised pavement marker (TRPM) 110 comprises a horizontally disposed leg or base member 112, and a vertically upstanding leg member 114 integrally connected to the horizontally disposed leg or base member 112 by means of a transitional region 116. An adhesive pad 118 is fixedly secured to an undersurface or lower face portion of the horizontally disposed leg or base member 112, and in turn, a release sheet 120 is secured to an undersurface or lower face portion of the adhesive pad 118 so as to prevent the adhesive pad 118 from being inadvertently adhesively bonded to any surface, other than that particular location or portion of the roadway to which the temporary raised pavement marker (TRPM) 110 is to be fixedly secured, prior to the actual fixation of the temporary raised pavement marker (TRPM) 110 upon a selected location or portion of the roadway. As was the case with the temporary raised pavement marker (TRPM) 10 of FIG. 1 of the present drawings as well as those of Speer et al., the upper end portion of the vertically upstanding leg member 114 of the temporary raised pavement marker (TRPM) 110 also comprises a pair of horizontally disposed rib members 122,122 which define a space or channel 124 therebetween for housing or accommodating a suitable reflector strip, not shown. Alternatively, the entire extrusion comprising the temporary raised pavement marker (TRPM) 110 may be fabricated from a suitable plastic material which is brightly colored, that is, it may be fabricated from a suitable resin material which is white or yellow.

The temporary raised pavement markers (TRPM) 110 are normally placed upon the roadway surface during an extended period of time that construction or other road work is being performed upon the roadway surface, and therefore prior to the completion of the entire construction or other road work as well as the application of the permanent traffic lane lines to the roadway surface. Accordingly, in order to protect the reflector strip, not shown, which is adapted to be disposed, housed, or accommodated within the space or channel 124 defined between the pair of horizontally disposed rib members 122,122, or alternatively, in order to protect the upper portion of the vertically upstanding leg member 114 when such portion of the temporary raised pavement marker (TRPM) 110 is to be used as the visual warning to oncoming motorists, from road paving materials, debris, and the like, a protective cover 126, fabricated from a suitable clear plastic material and having a substantially inverted U-shaped configuration, is disposed over the upper free edge portion of the temporary raised pavement marker (TRPM) 110. When the temporary raised pavement markers (TRPM) 110 are to be subsequently used in conjunction with, for example, their traffic lane delineation functions, the protective covers 126 are removed, and still further, when the need for the temporary raised pavement markers (TRPM) 110 is no longer required in view of the completion of the construction or other roadwork, and the application of the permanent traffic lane lines to the roadway surface, the temporary raised pavement markers (TRPM) 110 must obviously be removed from the roadway surface. Until now, the process for mounting and securing the temporary raised pavement markers (TRPM) 110 upon the roadway surfaces was accomplished manually whereby construction workmen or other personnel would have to manually deposit the temporary raised pavement markers (TRPM) 110 onto the roadway surface as a result of, for example, removing the release sheet 120 and pressing the temporary raised pavement marker (TRPM) 110 onto the roadway surface so as to cause the adhesive bonding of the same to the roadway surface. Obviously, such procedures are quite tedious and time-consuming. In addition, in view of the fact that the construction workmen or other personnel are physically present upon the particular roadway surface during the performance of such temporary raised pavement marker (TRPM) application operations, the workmen or personnel are unnecessarily exposed to dangerous vehicular conditions present upon the roadway.

A need therefore exists in the art for a new and improved device, machine, or apparatus for automatically applying temporary raised pavement markers (TRPM) to roadway surfaces so as to serve their useful purposes and functions in defining or delineating traffic lanes within construction zones or maintenance and repair areas, wherein, in particular, the temporary raised pavement markers (TRPM) can be applied to the roadway surface in a relatively rapid manner, wherein the construction workmen or other operator personnel do not need to tediously perform such removal operations manually, and in addition, and just as importantly, wherein the operator personnel or construction workers will not be needlessly exposed to dangerous roadway conditions presented by oncoming automotive vehicular traffic.

OBJECTS OF THE INVENTION

Accordingly, it is an object of the present invention to provide a new and improved device or apparatus for applying temporary raised pavement markers (TRPM) to roadway surfaces.

Another object of the present invention is to provide a new and improved device or apparatus for applying temporary raised pavement markers (TRPM) to roadway surfaces whereby the operational drawbacks and disadvantages characteristic of the PRIOR ART techniques currently employed for applying the temporary raised pavement markers (TRPM) to the roadway surfaces are effectively overcome.

An additional object of the present invention is to provide a new and improved device or apparatus for applying temporary raised pavement markers (TRPM) to roadway surfaces wherein the temporary raised pavement markers (TRPM) can be automatically applied to the roadway surfaces.

A further object of the present invention is to provide a new and improved device or apparatus for applying temporary raised pavement markers (TRPM) to roadway surfaces wherein the temporary raised pavement markers (TRPM) can be automatically applied to the roadway surfaces such that construction workers or other operator personnel do not have to manually apply such temporary raised pavement markers (TRPM) to the roadway surfaces in a tedious and relatively slow manner.

A last object of the present invention is to provide a new and improved device or apparatus for applying temporary raised pavement markers (TRPM) to roadway surfaces wherein the temporary raised pavement markers (TRPM) can be automatically applied to the roadway surfaces such that the construction workers or other operator personnel do not have to manually apply such temporary raised pavement markers (TRPM) to the roadway surfaces and thereby not be unnecessarily exposed to dangerous roadway conditions presented by oncoming automotive vehicular traffic.

SUMMARY OF THE INVENTION

The foregoing and other objectives are achieved in accordance with the teachings and principles of the present invention through the provision of a first embodiment of a new and improved apparatus or machine for automatically applying temporary raised pavement markers (TRPMs) to roadway surfaces which is operatively connected to a roadwork service vehicle or truck by means of a suitable hitch mechanism so as to be towed along a roadway surface onto which a plurality of temporary raised pavement markers (TRPMS) are to be placed. The machine or apparatus comprises a primary conveyor wherein temporary raised pavement markers (TRPM) are able to be mounted upon an upstream region thereof by means of an operator or workman stationed within a rear portion of the roadwork service vehicle or truck, and the primary conveyor conveys the temporary raised pavement markers (TRPMs) downstream to a position adjacent to a secondary conveyor. A slide mechanism transfers alternate ones of the temporary raised pavement markers (TRPMs) onto a secondary conveyor, and temporary raised pavement markers (TRPMS) disposed upon both the primary and secondary conveyors are then conveyed further downstream into vertically oriented delivery chutes. A pair of first transfer piston-cylinder assemblies move the temporary raised pavement markers (TRPMs) toward second applicator piston-cylinder assemblies which apply the pair of temporary raised pavement markers (TRPMs) onto the roadway surface in adjacent pairs, thereby simulating double-yellow traffic lane lines for separating-opposite lanes of vehicular traffic. In accordance with a second embodiment of the present invention, wheel applicators are utilized to apply the temporary raised pavement markers (TRPMS) onto the roadway surface in lieu of the piston-cylinder applicators.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein:

FIG. 4 is a front perspective view showing the upper, horizontally disposed upstream end portion of the primary temporary raised pavement marker (TRPM) conveyor upon which the temporary raised pavement markers (TRPM) are initially loaded by means of an operator or workman;

FIG. 5 is a rear elevational view wherein the downwardly inclined section of the primary temporary raised pavement marker (TRPM) conveyor has the paddle members fixedly mounted upon the outer surface thereof so as to be disposed in an upstanding manner upon the upper flight section of the conveyor so as to be capable of conveying the temporary raised pavement markers (TRPM) therealong;

DETAILED DESCRIPTION OF THE PREFERRED EMBODIMENT

Figure 1:
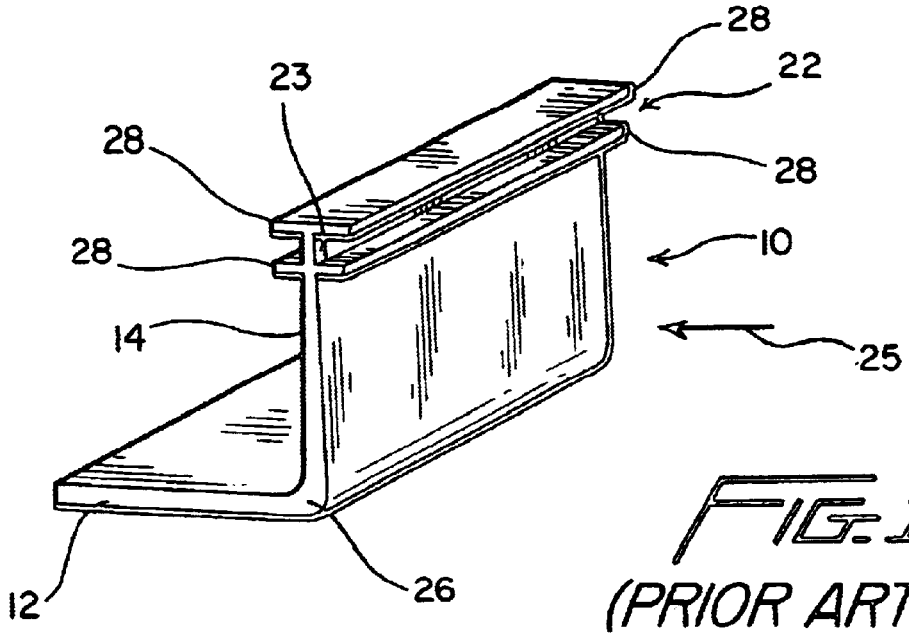
FIG. 1 (PRIOR ART)
FIG. 1 is a perspective view of a conventional PRIOR ART temporary raised pavement marker (TRPM)

Referring now to the drawings, and more particularly to FIGS. 3–6 thereof, a new and improved apparatus or machine for automatically applying temporary raised pavement markers (TRPM) to roadway surfaces is disclosed and is generally indicated by the reference character 210. The machine or apparatus 210 is seen to comprise a wheeled vehicle 212 comprising a central housing 214 rollably supported by means of a pair of wheel assemblies 216, and a trailer hitch assembly 218 permits the machine or apparatus 210 to be pulled along a roadway surface 220 by means of a roadwork service vehicle or truck 222. Without describing the trailer hitch assembly 218 in great detail in view of the fact that the trailer hitch assembly 218 does not comprise a critically important feature of the actual invention, it is noted that the trailer hitch assembly 218 does comprise a plurality of telescopically adjustable members which permits the wheeled vehicle 212, upon which the apparatus or machine of the present invention 210 is operatively mounted, to be operatively connected to the roadwork service truck or vehicle 222 in such a manner as to be selectively towed either directly behind the roadwork service truck or vehicle 222 or to be disposed at a towed position which is effectively offset toward one side of the roadwork service truck or vehicle 222. In either case, in accordance with the operative principles and teachings of the present invention, the apparatus or machine 210 is capable of applying a plurality of temporary raised pavement markers (TRPM) to the roadway surface 220 in dual sets of markers 110 so as to effectively simulate, for example, a double yellow line which conventionally separates oppositely directed or oncoming lanes of vehicular traffic.

Figure 3:
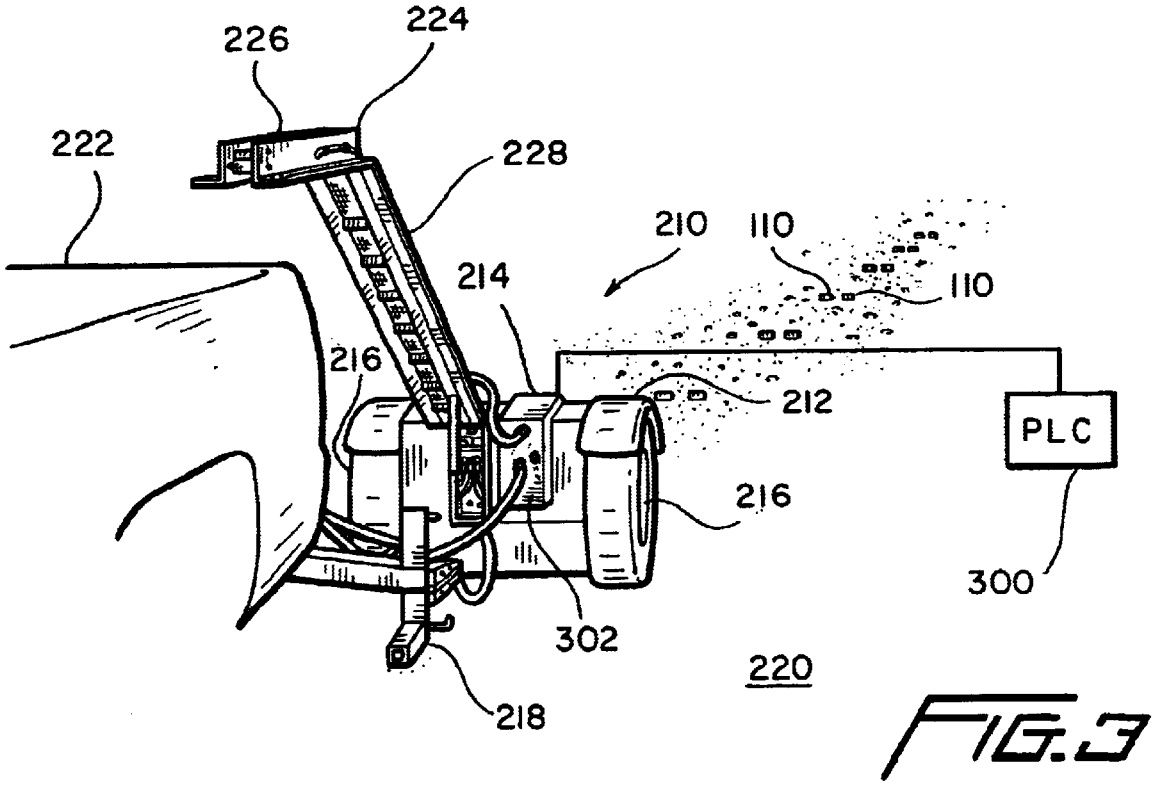
FIG. 3 is a left side, rearward facing perspective view of the new and improved apparatus or machine, for automatically applying temporary raised pavement markers (TRPM) to roadway surfaces, as constructed in accordance with the principles and teachings of the present invention and wherein the apparatus or machine is shown being towed behind a roadwork service vehicle or truck so as to apply temporary raised pavement markers (TRPM) to roadway surfaces in longitudinally spaced pairs so as to simulate, for example, a permanent double traffic line which normally separates opposite moving oncoming lanes of traffic.

The apparatus or machine 210 is seen to further comprise a primary conveyor 224 which comprises an upstream, horizontally disposed section 226, and a downstream, downwardly inclined section 228, and as can best be appreciated from FIG. 3, when the wheeled vehicle portion 212 of the apparatus or machine 210 of the present invention is operatively connected to the roadwork service vehicle or truck 222 by means of the trailer hitch assembly 218, the upstream end portion of the upstream, horizontally disposed section 226 will be disposed above the rear end section of the roadwork service vehicle or truck 222 so that an operator or workman, who is stationed within or upon the rear end section of the roadwork service vehicle or truck 222, can serially load temporary raised pavement markers (TRPM) 110 onto the upstream, horizontally disposed section 226 of the primary conveyor 224. As can be best appreciated from FIGS. 4–6, the upstream, horizontally disposed section 226 of the primary conveyor 224 is formed by means of a pair of laterally spaced angle irons 230,230, and a centrally located U-shaped channel bar 232, wherein the upstanding leg members of the channel bar 232 are welded, for example, to the upper ends of the vertically oriented leg members of the angle irons 230,230.

The base portion of the U-shaped channel bar 232 therefore effectively serves as a support platform upon which an upper flight section of a primary conveyor belt 234 is translationally supported during the conveyance movement thereof along the horizontally disposed conveyor section 226, and it is seen further that the outer surface portion of the primary conveyor belt 234 is provided with a plurality of longitudinally spaced, perpendicularly oriented paddies or tabs 236 for operatively engaging and seating the plurality of temporary raised pavement markers (TRPM) 110. Accordingly, as the primary conveyor belt 234 is conveyed along the support platform of the upstream, horizontally disposed section 226 of the primary conveyor 224, as well as along the downstream, downwardly inclined section 228 of the primary conveyor 224, the paddles or tabs 236 will cause conveyance of the temporary raised pavement markers (TRPM) 110 along the primary conveyor 224. In connection with the downstream, downwardly inclined section 228 of the primary conveyor 224, it can best be appreciated from FIGS. 5 and 6 that the structure of such downstream, down-wardly inclined conveyor section 228 is somewhat similar to that of the upstream, horizontally disposed section 226 of the primary conveyor 224, with slight variations.

More particularly, for example, the downwardly inclined conveyor section 228 may comprise a pair of laterally separated T-shaped angle iron members 238,238 wherein the orientation of each angle iron member 238 is effectively rotated 90° such that the normally horizontally oriented upper cross-member 240 is oriented vertically while the normally vertically oriented leg member 242 is oriented horizontally. Fixedly interposed between the vertically oriented members 240,240 of the two laterally spaced angle iron members 238, 238 is a substantially U-shaped channel bar 244 wherein, as was the case with the U-shaped channel bar 232, the base portion of the U-shaped channel bar 244 effectively serves as a support platform upon which the upper flight section of the primary conveyor belt 234 is translationally supported during the conveyance movement thereof along the downwardly inclined conveyor section 228. The downstream end portion of the downwardly inclined conveyor section 228 has a conveyor drive pulley, not shown, around which the primary conveyor belt 234 is routed so as to in fact be driven thereby, and the upstream end portion of the horizontally disposed upstream conveyor section 226 similarly has an idler pulley 246 rotatably mounted upon and between the vertically oriented leg members of the angle iron members 230,230 by means of a pair of mounting brackets 248, as best seen in FIG. 4, whereby the primary conveyor belt 234 comprises an endless conveyor belt. Accordingly, as can best be appreciated from FIG. 6, as the primary conveyor belt 234 is conducted back from the downstream end region of the downwardly inclined conveyor section 228 toward the upstream end region of the horizontally disposed conveyor section 226, a lower flight section of the primary conveyor belt 234 is effectively formed and is interposed between the vertically downwardly extending portions of the vertically oriented members 240, 240 of the two laterally spaced angle iron members 238, 238.

In order to provide the primary conveyor belt 234 with a predetermined degree of tension, as well as to conform the routing of the lower flight section of the primary conveyor belt 234 to that of the orientations of the horizontally disposed and inclined conveyor sections 226,228, a tension roller 250 is rotatably mounted underneath the primary conveyor 224 within the vicinity of the intersection of the horizontally disposed conveyor section 226 and the downwardly inclined conveyor section 228. The tension roller 250 has its opposite ends fixedly mounted within a pair of mounting brackets 252,252, and it is seen that the mounting brackets 252,252 are adjustably mounted upon undersurface portions of the horizontally oriented leg members 242,242 of the angle iron members 238,238 by means of suitable bolt fasteners 254,254 and slot structures 256,256 formed within the mounting brackets 252,252. It is seen that the lower flight section of primary conveyor belt 234 passes over the tension roller 250, and accordingly, the tension roller 250 has a squirrel-cage structure which will permit the paddles or tabs 236 of the primary conveyor belt 234, which project downwardly from the lower flight section of the primary conveyor belt 234, to be operatively accommodated without substantial interference as the paddles or tabs 236 traverse or pass over the tension roller 250.

As has been noted hereinbefore, when the plurality of temporary raised pavement markers (TRPM) 110 are to be placed or loaded upon the upstream, horizontally disposed section 226 of the primary conveyor 224 by means of an operator or workman, the release sheet 120 will firstly be removed from the underside of the adhesive pad 118 of each temporary raised pavement marker (TRPM) 110, and each temporary raised pavement marker (TRPM) 110 is then placed upon one of the vertically upstanding paddles, tabs, or carriers 236 disposed upon the upper flight section of the conveyor belt 234 which is supported upon the base portion of the U-shaped channel bar 232 as seen in FIG. 4. When each temporary raised pavement marker (TRPM) 110 is placed upon a respective one of the paddles, tabs, or carriers 236, the temporary raised pavement marker (TRPM) 110 will be oriented such that the apex or transitional region 116 of the temporary raised pavement marker (TRPM) 110 will extend or be disposed upwardly. In addition, the normally horizontal leg member 112 of the temporary raised pavement marker (TRPM) 110 will be inclined vertically downwardly from the elevated apex or transitional region 116 so as to extend in the downstream direction, while the normally vertical leg member 114 of the temporary raised pavement marker (TRPM) 110 will be inclined vertically downwardly from the elevated apex or transitional region 116 so as to extend in the upstream direction. In view of such set positions of the plurality of temporary raised pavement markers (TRPM) 110 upon their respective ones of the paddles, tabs, or carriers 236, and in view of the horizontal disposition of the upper flight section of the conveyor belt 234 as supported upon the base portion of the U-shaped channel bar 232 of the upstream, horizontally disposed section 226 of the primary conveyor 224, no additional structure is required to maintain the plurality of temporary raised pavement markers (TRPM) 110 disposed or seated upon their respective ones of the carriers, paddles, or tabs 236.

However, when the conveyor belt 234 continues to move in the downstream direction so as to travel over the downwardly inclined conveyor section 228 of the primary conveyor 224, the temporary raised pavement markers (TRPM) 110 will tend to become dislodged or separated from their conveyor tabs, paddles, or carriers 236 unless restrained in some manner. Accordingly, structure must be provided upon the downwardly inclined conveyor section 228 of the primary conveyor 224 in order to restrain the temporary raised pavement markers (TRPM) 110 and to maintain the same seated upon their respective tabs, paddles, or carriers 236 so that the temporary raised pavement markers (TRPM) 110 can in fact be properly conveyed downstream, at precise moments in time, for application onto the roadway surface 220 by means of the additional structural components comprising the present invention, as will be disclosed further hereinafter.

As best seen in FIGS. 4 and 5, the structure for restraining the temporary raised pavement markers (TRPM) 110, and for maintaining the same seated upon their conveyor belt paddles, tabs, or carriers 236, comprises a pair of oppositely disposed flanged members 258 which extend inwardly toward each other from the upper, vertically oriented members 240,240 of the two laterally spaced angle iron members 238,238. The flanged members 258 will effectively be disposed a predetermined distance above the base portion of the U-shaped channel bar 244 so as to define therewith a space therebetween within which the temporary raised pavement markers (TRPM) 110 can be accommodated. The inner edge portions of the flanged members 258 will also extend inwardly a sufficient distance so as to effectively cover the outer side regions of the temporary raised pavement markers (TRPM) 110 thereby preventing the same from flipping or inverting whereby the temporary raised pavement markers (TRPM) 110 will not become dislodged or separated from their respective conveyor paddles, tabs, or carriers 236. In furtherance of the function of the inwardly extending flanged members 258, it is seen, as best appreciated from FIG. 4, that upstream end portions of the flanged members 258 commence at the downstream end portion of the horizontally disposed section 226 of the primary conveyor 224, or in other words, at the intersection of the horizontally disposed and the downwardly inclined sections 226,228 of the primary conveyor 224.

Figure 6:
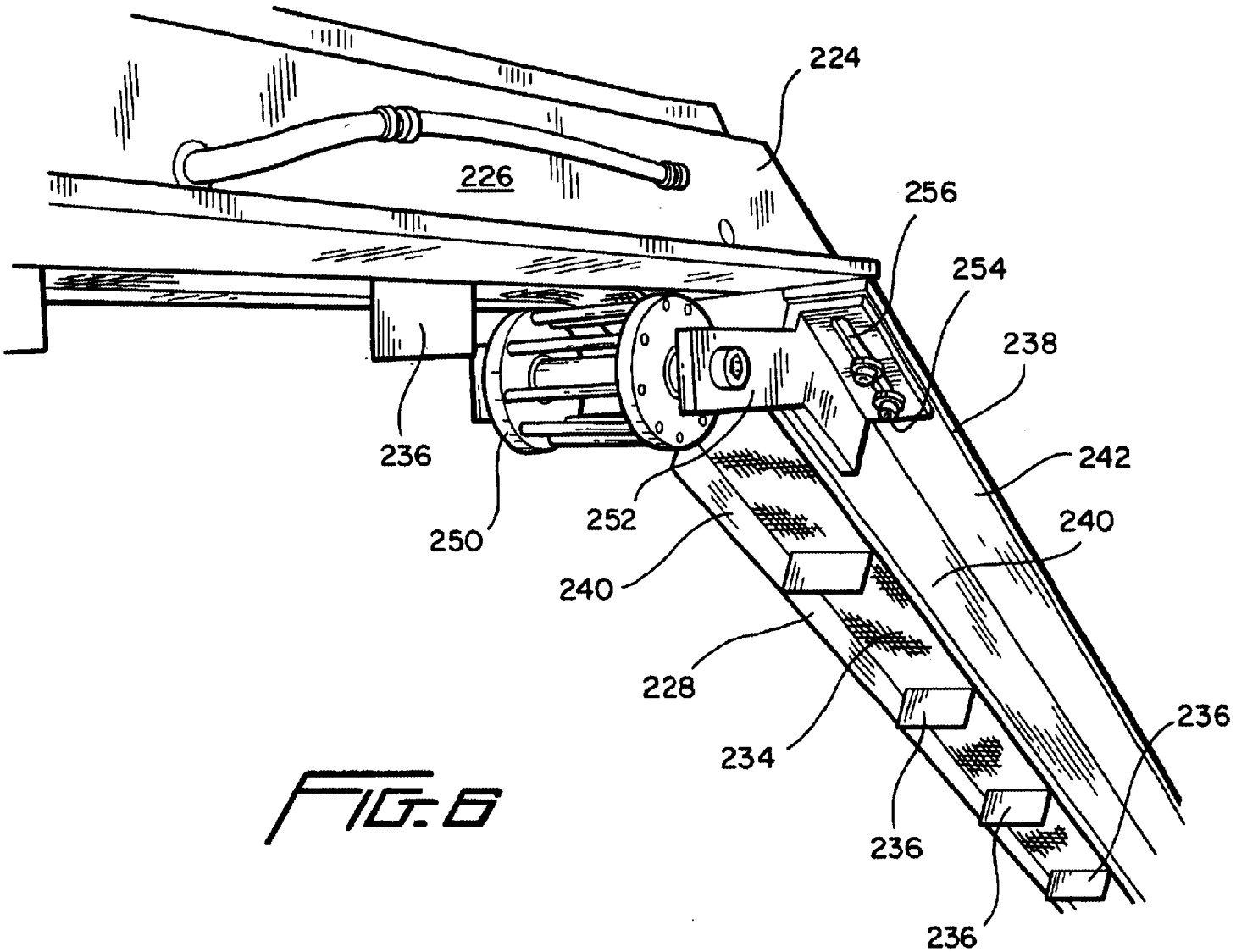
FIG. 6 is a bottom, front perspective view of the downwardly inclined section of the primary temporary raised pavement marker (TRPM) conveyor as shown in FIG. 5 showing the dependent paddle members being conveyed along the lower return flight section of the conveyor.
Figure 7:
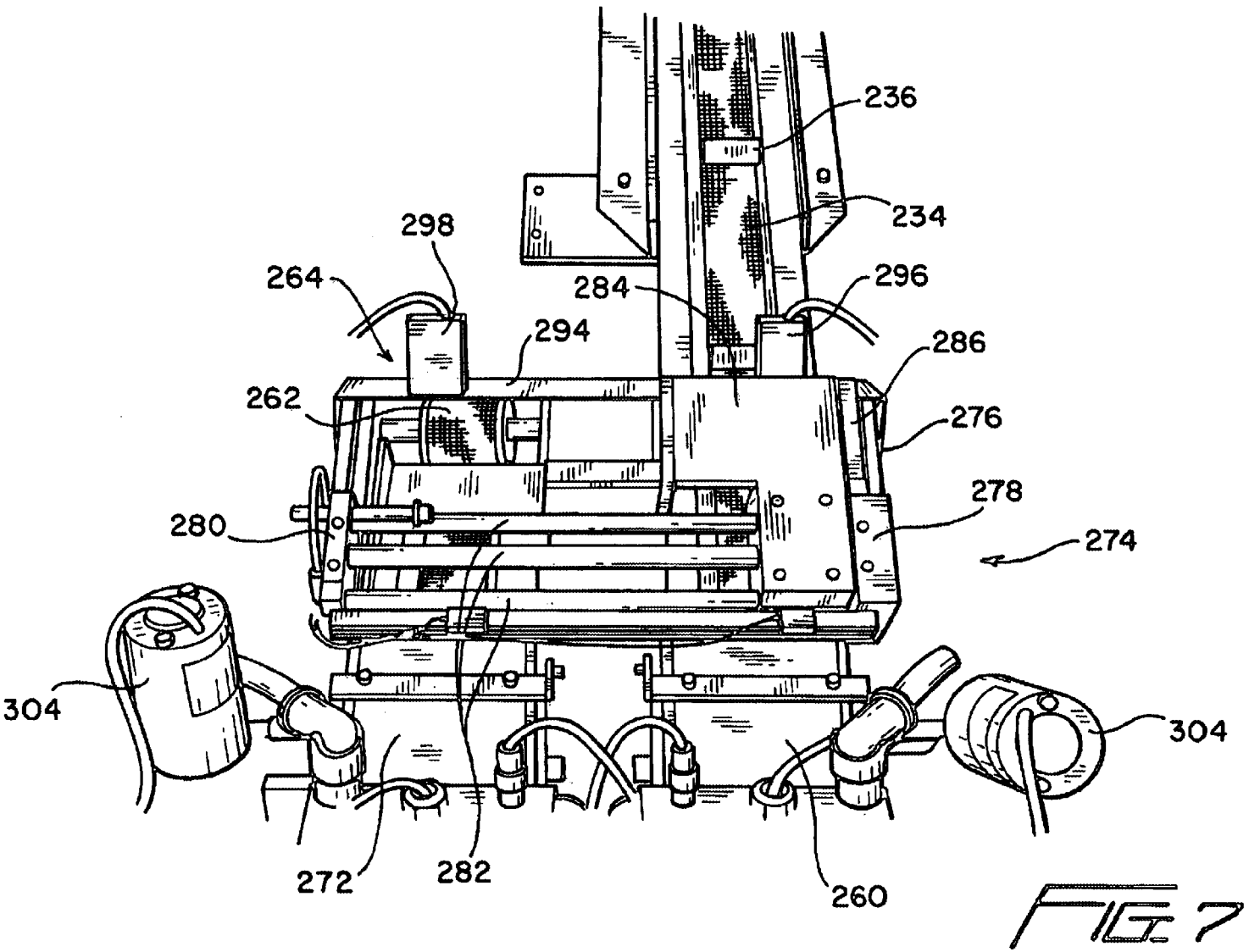
FIG. 7 is a rear perspective view of the internal components of the new and improved temporary raised pavement marker (TRPM) applicator apparatus or machine of the present invention showing the details of the pavement marker slide mechanism operatively associated with the primary and secondary conveyors for transferring a pavement marker from the primary conveyor to the secondary conveyor.
Figure 8:
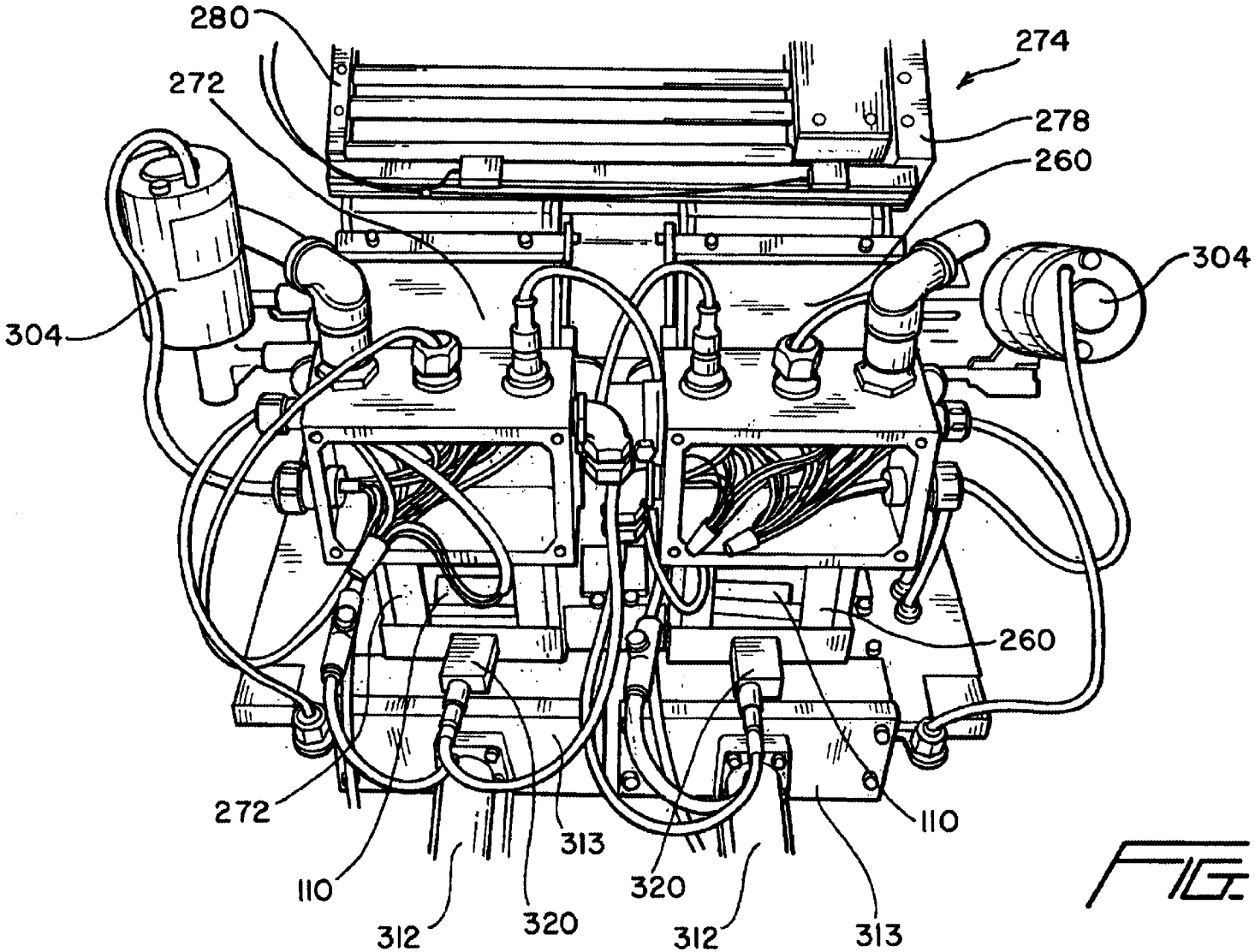
FIG. 8 is a rear perspective view of the internal components of the new and improved apparatus or machine, for automatically applying temporary raised pavement markers (TRPM) to roadway surfaces as shown in FIG. 3 and illustrating the primary and secondary conveyors, the slide mechanism for transferring a temporary raised pavement marker (TRPM) from the primary conveyor to the secondary conveyor, and the transfer piston-cylinder assemblies for moving the temporary raised pavement markers (TRPM), after being delivered vertically downwardly by conveyor chutes, to applicator piston-cylinder assemblies for application of the temporary raised pavement markers (TRPM) onto the roadway surface.
Figure 12:
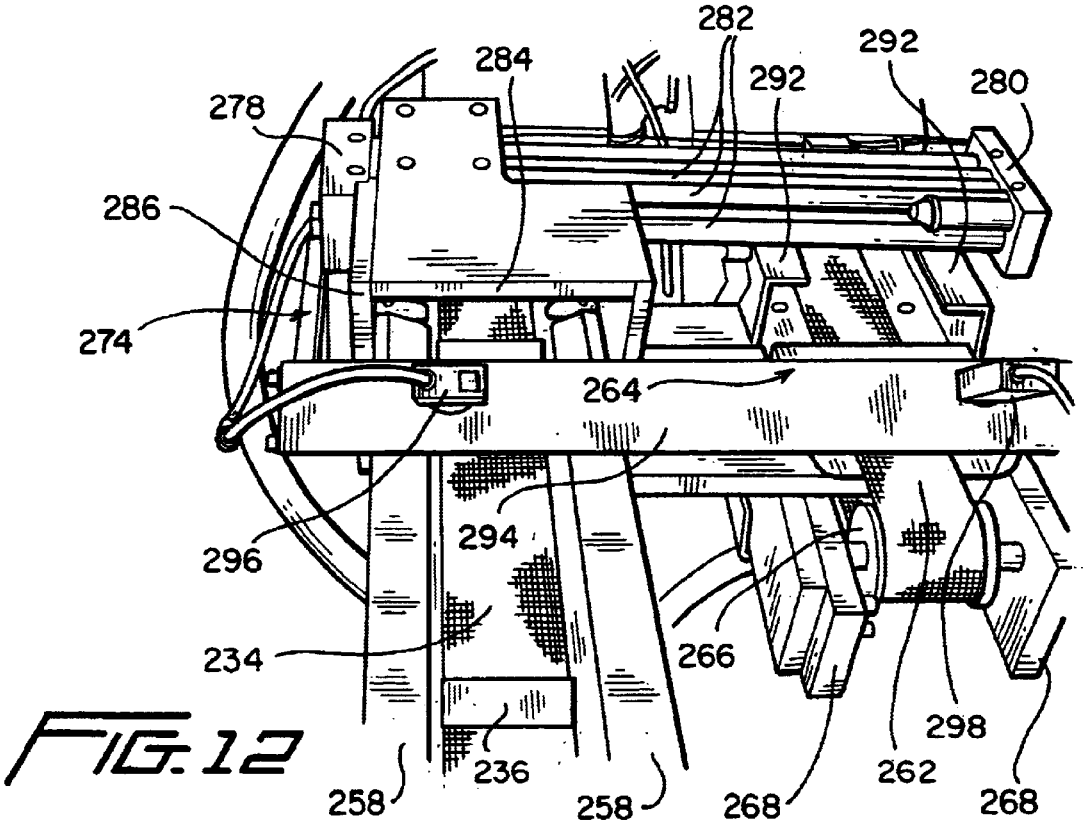
FIG. 12 is an enlarged front perspective view of the primary and secondary conveyors, and the pavement marker slide mechanism operatively associated therewith, disclosing details of the primary and secondary conveyors which enable a pavement marker to be laterally transferred from the primary conveyor to the secondary conveyor.
Figure 13:
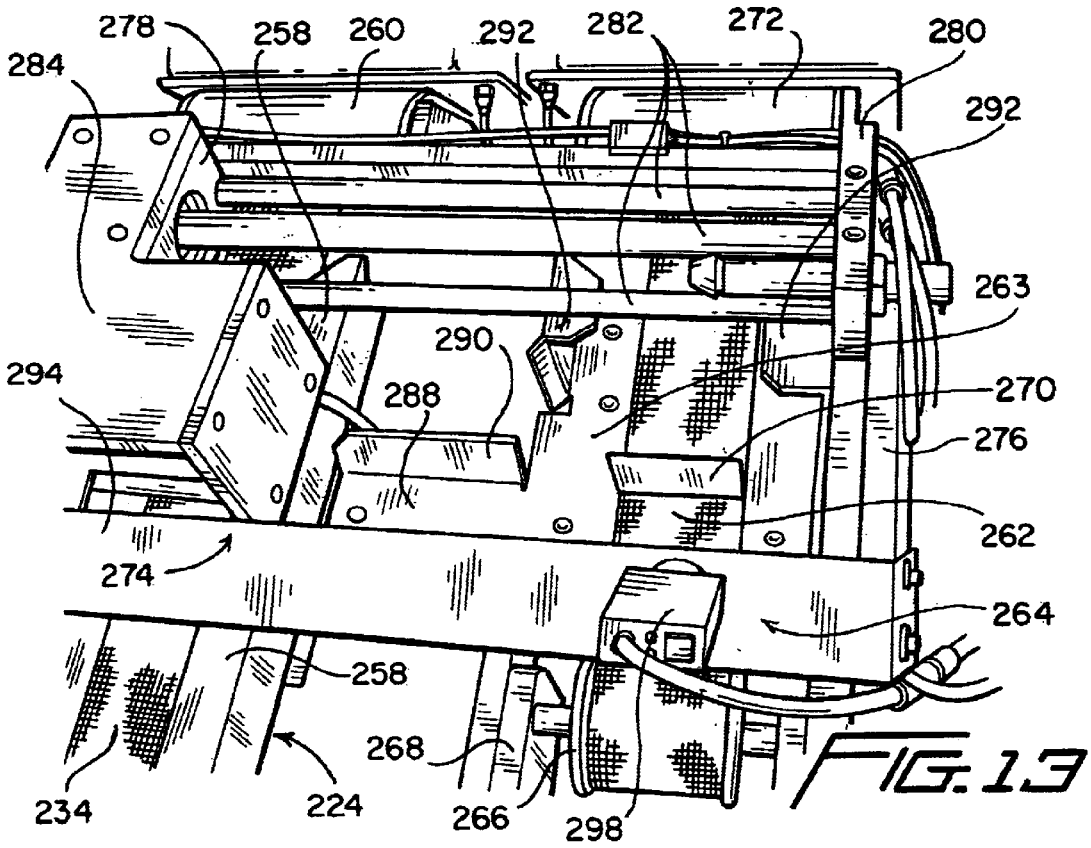
FIG. 13 is an enlarged front perspective view of the primary and secondary conveyors, and the pavement marker slide mechanism operatively associated therewith, showing a bridge member interposed between the primary and secondary conveyors for enabling the pavement marker slide mechanism to laterally transfer a pavement marker from the primary conveyor onto an empty pavement marker paddle member of the secondary conveyor.
Figure 14:
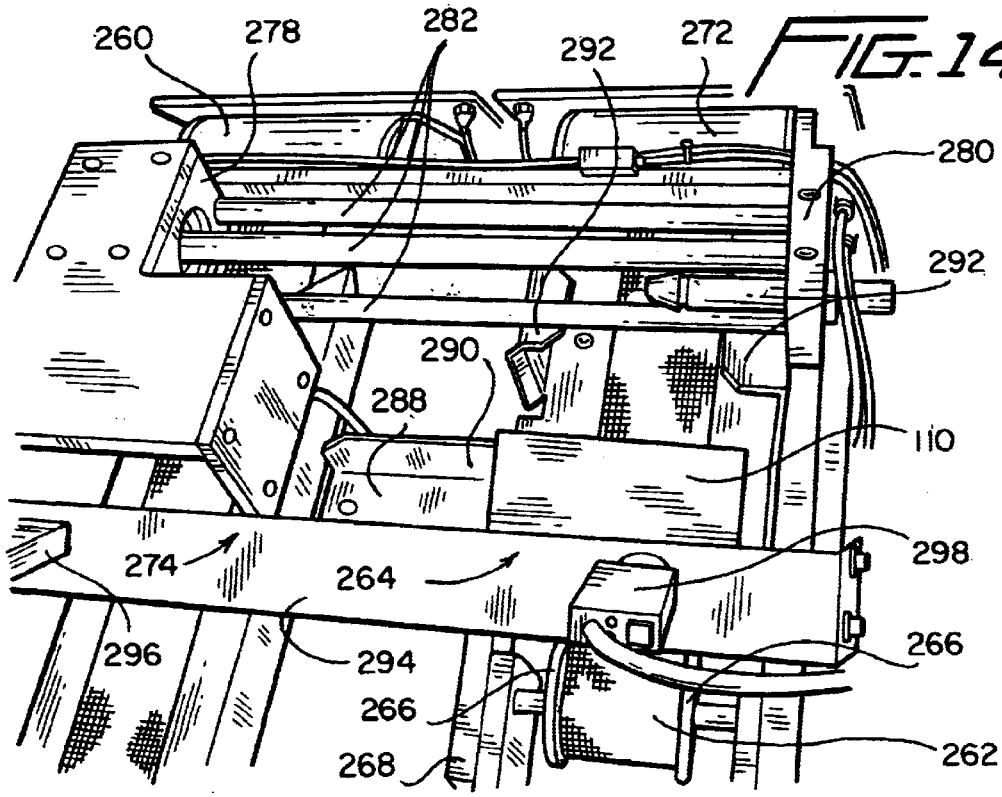
FIG. 14 is an enlarged front perspective view similar to that of FIG. 13 showing, however, the transferred pavement marker placed over the paddle member of the secondary conveyor.
Figure 15:
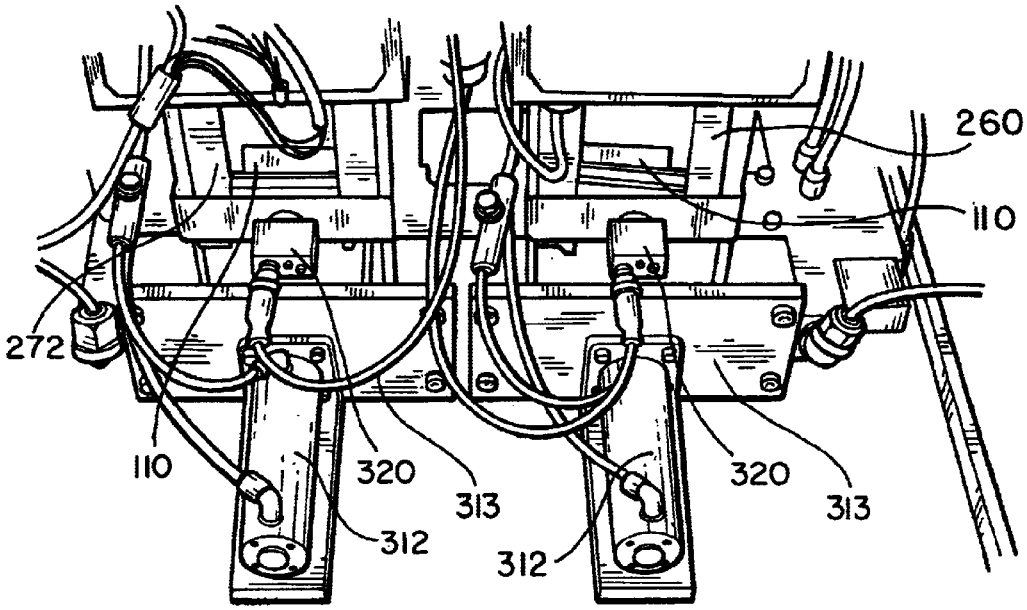
FIG. 15 is a rear perspective view showing a pair of pavement markers disposed within the bottom regions of the delivery chutes, and the pair of transfer piston-cylinder assemblies in readiness for simultaneously moving the pair of pavement markers toward the applicator piston-cylinder assemblies.

Continuing further, and with reference now being made to FIGS. 7–16*c*, a first vertically oriented delivery chute 260, the upper end of which is shown in FIGS. 13 and 14, while the lower end thereof is shown in FIGS. 8 and 15, is disposed adjacent to the lower downstream end of the inclined section 228 of the primary conveyor 224. In this manner, as the downstream end of the primary conveyor belt 234 is looped around the primary conveyor drive pulley, not shown, so as to continue back toward the upstream end of the primary conveyor belt 234 along the lower flight section thereof as shown in FIG. 6, the plurality of temporary raised pavement markers (TRPM) 110 will be discharged from the primary conveyor belt 234 and into the first vertically oriented delivery chute 260. Laterally disposed toward the left of the downstream region of the primary conveyor belt 234, there is disposed a second auxiliary conveyor belt 262 which is adapted to be movably mounted upon a base surface portion 263 of a second auxiliary conveyor 264 which comprises structure that is substantially similar to that of the primary conveyor 224 except that the longitudinal extent or length of the second auxiliary conveyor 264 is considerably less than that of the first primary conveyor 224. As best seen, for example, within FIGS. 7 and 11–14, the upstream end of the second auxiliary conveyor belt 262 is routed around an idler pulley 266 rotatably mounted within suitable bracket structures 268 operatively associated with the second auxiliary conveyor 264, and as best seen in FIG. 13, the second auxiliary conveyor belt 262 has a plurality of paddles, carriers, or tabs 270 fixedly mounted thereon in a manner similar to the disposition of the paddles, tabs, or carriers 236 fixedly mounted upon the primary conveyor belt 234. In this manner, as was the case with the primary conveyor belt 234, a plurality of temporary raised pavement markers (TRPM) 110 can be conveyed upon the second auxiliary conveyor belt 262 and discharged at the downstream end thereof into a second vertically oriented delivery chute 272 which is clearly shown within FIGS. 8,9,9*a*, and 15.

The purpose of having the second auxiliary conveyor 264, and the second auxiliary conveyor belt 262 thereof, is to provide the machine or apparatus 210 of the present invention with the capability, if desired, of simultaneously discharging temporary raised pavement markers (TRPM) 110 in a side-by-side fashion onto the roadway surface 220 as disclosed within FIG. 3 so as to, for example, simulate a double-yellow line separating oncoming lanes of vehicular traffic. In addition, it is also more expeditious from an operational point of view to simply require an operator or workman to serially load a plurality of temporary raised pavement markers (TRPM) 110 onto a single conveyor and to provide a means within the apparatus or machine 210 for subsequently transferring, for example, alternative ones of the temporary raised pavement markers (TRPM) 110 from the first primary conveyor 224 to the second auxiliary conveyor 264 than to require the operator or workman to simultaneously load temporary raised pavement markers (TRPM) 110 into both the primary and auxiliary conveyors 224,264. Accordingly, in order to achieve such transfer of temporary raised pavement markers (TRPM) 110 from the first primary conveyor 224 to the second auxiliary conveyor 264, a laterally or transversely movable slide mechanism 274 is employed. More particularly, as seen within FIGS. 7, 8, and 10–14, the slide mechanism 274 comprises a framework 276 upon which a pair of oppositely disposed right and left end plates 278,280 are fixedly mounted, and a plurality of guide rods 282 have their opposite ends fixedly mounted within the end plates 278,280. A slide block 284 is mounted upon the guide rods 282 for slidable reciprocal movements between the right and left end plates 278,280 under the control of suitable pneumatically operated means, not shown, and a transfer plate 286 is fixedly mounted upon the right side of the slide block 284. Predetermined ones, such as, for example, alternative ones, of the temporary raised pavement markers (TRPM) 110, conveyed downstream upon the first primary conveyor belt 234 and toward the slide block 284 by means of its upstanding carriers, paddles, or tabs 236, as shown in FIG. 12, are adapted to be transferred to the second auxiliary conveyor belt 262, as shown in FIG. 13, in such a manner that the transferred temporary raised pavement markers (TRPMs) 110 will be deposited or seated upon the paddles, tabs, or carriers 270 of the second auxiliary conveyor belt 262 whereby the transferred temporary raised pavement markers (TRPMs) 110 can be conveyed further downstream by means of the second auxiliary conveyor belt 272 toward the second vertically oriented delivery chute 272.

As best seen in FIG. 13, in order to actually achieve such transfer of the temporary raised pavement markers (TRPM) 110 from the primary conveyor belt 234 to the second auxiliary conveyor belt 262, the upstream end region of the base section 263 of the second auxiliary conveyor 264 is integrally provided with a laterally extending bridge platform 288 which is disposed within the space separating the first primary and second auxiliary conveyors 224,264 so as to effectively provide a laterally extending continuum between the first primary and second auxiliary conveyors 224,264. In addition, an upstanding bridge plate 290 is integrally formed upon the bridge platform 288 so as to effectively support each one of the temporary raised pavement markers (TRPM) 110 as each one of the temporary raised pavement markers (TRPM) 110 is individually transferred from the first primary conveyor 224 to the second auxiliary conveyor 264 by means of the transfer plate 286 mounted upon the slide block 284. It is to be understood that the transfer plate 286 has a slot, not shown, formed within a bottom portion thereof such that, as the slide block 284 is moved from its extreme right position, as shown in FIG. 7, at which the slide block 284 is aligned with the first primary conveyor 224, to its extreme left position at which the slide block 284 will be aligned with the second auxiliary conveyor 264, the transfer plate 286 can operatively engage a temporary raised pavement marker (TRPM) 110 disposed upon one of the paddles, tabs, or carriers 236 of the first primary conveyor belt 234, transfer the same across the bridge platform 288 and over the bridge plate 290, and onto one of the paddles, tabs, or carriers 270 of the second auxiliary conveyor belt 262 as disclosed within FIGS. 13 and 14, without encountering any interference with the upstanding bridge plate 290.

Continuing further with respect to the transversely slidable movement of the slide block 284, and in particular in order to facilitate the transverse movement of the transfer plate 286, it is additionally noted, as can best seen in FIGS. 12 and 13, that sections of the oppositely disposed inwardly extending flanged members 258 of the downwardly inclined conveyor section 228 of the primary conveyor 224 are effectively interrupted or removed within the region of the slide block 284 and transfer plate 286. In a similar manner, the channel member which effectively forms the second auxiliary conveyor 264 is provided with inwardly extending flanged members 292 so as to serve the same function in conjunction with the second auxiliary conveyor 264 as the inwardly extending flanged members 258 provide in conjunction with the downwardly inclined conveyor section 228 of the primary conveyor 224, however, it is noted that the inwardly extending flanged members 292 commence at a position which is immediately downstream of that section of the second auxiliary conveyor 264 onto which a temporary raised pavement marker (TRPM) 110 has been transferred by the slide block 284 and transfer plate 286.

In order to actually control the movement of the slide block 284 and the transfer plate 286 so as to in fact achieve the transfer of the individual temporary raised pavement markers (TRPMs) 110 from the first primary conveyor 224 to the second auxiliary conveyor 264, it is further noted, as best seen in FIGS. 7 and 12–14, that a mounting bracket 294 is fixedly mounted upon the slide mechanism framework 276, and a pair of photodetectors 296,298, or other similar devices, are fixedly mounted upon the mounting bracket 294 so as to respectively operatively monitor the downstream portion of the first primary conveyor belt 234 within the region of the slide block 284, and the upstream portion of the second auxiliary conveyor belt 262. The photodetectors 296,298 are utilized to monitor and detect the presence or absence of temporary raised pavement markers (TRPMS) 110 at their relative transversely aligned positions upon both the first primary and second auxiliary conveyor belts 234, 262 along the transverse axis passing through the bridge plate 290 as may be best appreciated from FIGS. 13 and 14. More particularly, as may best be appreciated from FIG. 7, as one of the paddles, tabs, or carriers 236 of the first primary auxiliary conveyor belt 234, upon which a temporary raised pavement marker (TRPM) 110 is positioned, approaches the slide mechanism 274, the presence of a temporary raised pavement markers (TRPM) 110 upon the paddle, tab, or carrier 236 will be detected by means of the photodetector 296 and an appropriate signal generated thereby will be transmitted to a program logic controller (PLC) 300 which is located within a control box 302 which forms a part of the central housing 214 of the apparatus or machine 210 as disclosed within FIG. 3. At the same time, a suitable signal is generated by the photodetector 298 indicating that the transversely aligned and corresponding paddle, tab, or carrier 270 of the second au-xiliary conveyor belt 262 does not have a temporary raised pavement marker (TRPM) 110 positioned thereon, and such signal is also transmitted to the program logic controller (PLC) 300.

Accordingly, the program logic controller (PLC) 300 will generate a signal to actuate the control mechanism, not shown, operatively associated with the slide mechanism 274 so as to initiate transverse slidable movement of the slide block 284 and the transfer plate 286 whereby the temporary raised pavement marker (TRPM) 110 which has been positioned upon the paddle, tab, or carrier 236 of the first primary conveyor belt 234 is now transferred onto the transversely aligned paddle, tab, or carrier 270 of the second auxiliary conveyor belt 262. Both of the first primary and second auxiliary conveyor belts 234,262 are adapted to be driven, as will be more particularly disclosed shortly hereinafter, by suitable drive mechanisms in accordance with an indexable type drive mode of operation which is also controlled by means of the program logic controller (PLC) 300, and accordingly, at this point in time, the second auxiliary conveyor belt 262 is maintained stationary.

Subsequently, after the temporary raised pavement marker (TRPM) 110 has been transferred onto the second auxiliary conveyor belt 262, the slide block 284 and transfer plate 286 are returned to their original position as shown in FIG. 7 by means of its control system controlled by means of the program logic controller (PLC) 300, and the program logic controller (PLC) 300 also generates a signal so as to index the primary conveyor belt 234 so as to advance the next paddle, tab, or carrier 236, upon which a subsequent temporary raised pavement marker (TRPM) 110 is located, such that the presence of such temporary raised pavement marker (TRPM) 110 is now detected by means of the photodetector 296. Since both photodetectors 296,298 have now transmitted PRESENT signals to the program logic controller (PLC) 300, the program logic controller (PLC) 300 will now generate appropriate signals to both of the primary and auxiliary conveyor drive mechanisms whereby the primary and auxiliary conveyor belts 234, 262 will be advanced so as to convey the respective temporary raised pavement markers (TRPM) 110 toward the first and second vertically oriented delivery chutes 260,272.

Figure 9A:
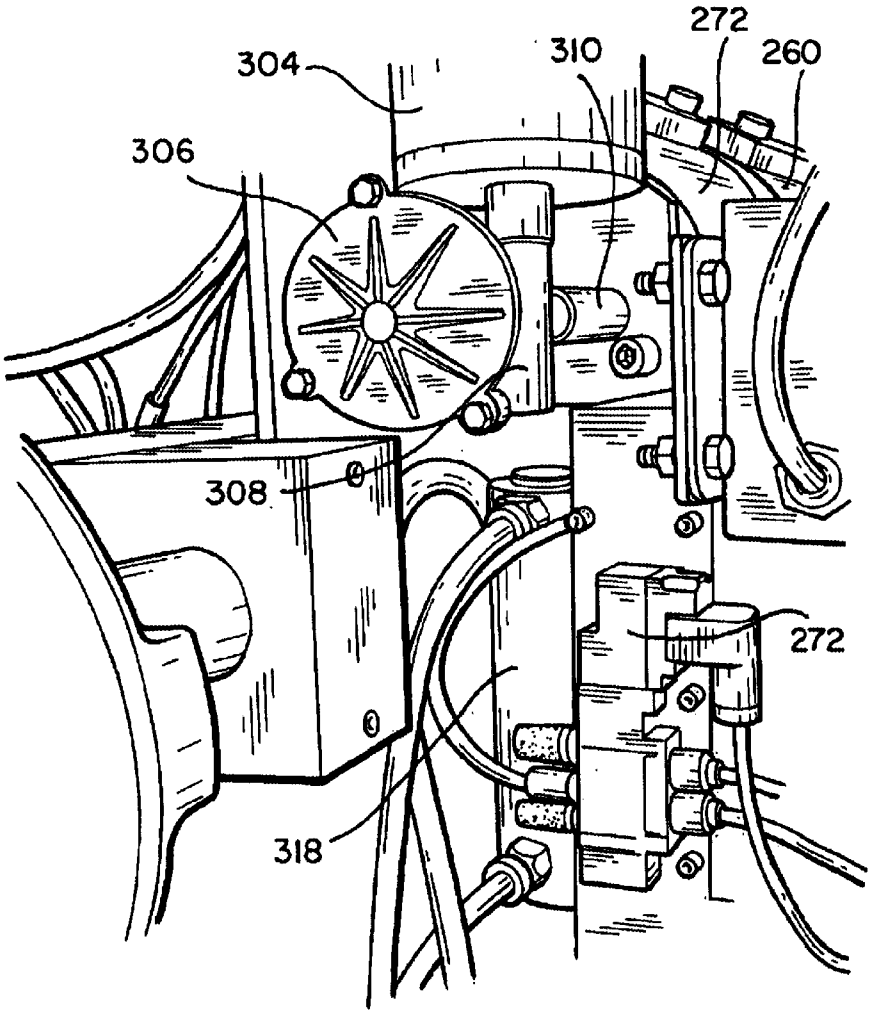
FIG. 9*a* is an enlarged view of FIG. 9 showing further details of the disposition of one of the ram piston-cylinder assemblies with respect to one of the temporary raised pavement marker (TRPM) delivery chutes and its operatively associated placement piston-cylinder assembly.
Figure 9:
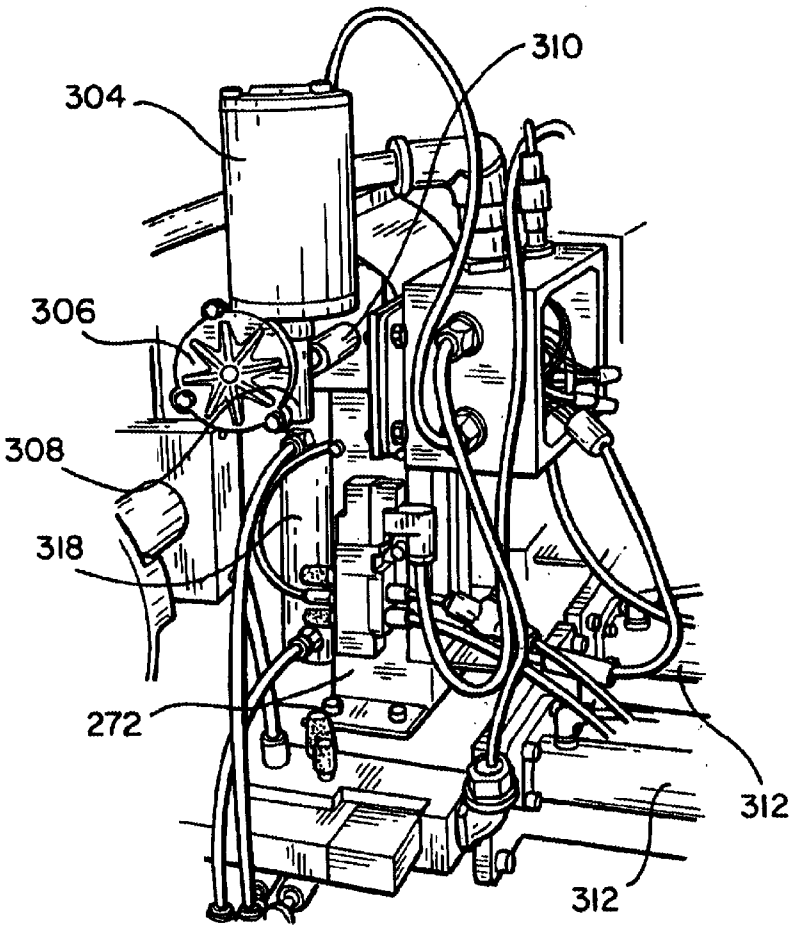
FIG. 9 is a left side perspective view showing one of the motor-gear conveyor drives, one of the vertically oriented delivery chutes, and the transfer piston-cylinder assembly components of the new and improved temporary raised pavement marker (TRPM) applicator apparatus or machine.

It is to be noted that the distance defined between the transfer positions, at which the paddles, tabs, or carriers 236,270 of the first primary and second auxiliary conveyor belts 234,262 are transversely aligned with respect to each other, and the first and second delivery chutes 260,272 is the same as the distance defined between successive paddles, tabs, or carriers 236,270 upon the first primary and second auxiliary conveyor belts 234,262 so as to always ensure the synchronization of the feeding of successive temporary raised pavement markers (TRPM) 110, disposed upon the first primary conveyor belt 234, to the transfer position of the first primary conveyor belt 234 with the subsequent feeding of the temporary raised pavement markers (TRPM) 110, disposed upon both of the first primary and second auxiliary conveyor belts 234,262 at their respective transversely aligned transfer positions, from such transversely aligned positions to the first and second delivery chutes 260,272. It is of course to be further realized that since the drive mechanisms for the first primary and second auxiliary conveyor belts 234,262 are under the control of the program logic controller (PLC) 300, the frequency or cyclical rate at which the conveyor belt drive mechanisms are activated may be varied by the program logic controller (PLC) 300 so as to, in turn, vary the distances defined between successive locations or sites at which successive ones of the temporary raised pavement markers (TRPM) 110 are applied to or mounted upon the roadway surface 220. In connection with the drive mechanisms for the first primary and second auxiliary conveyor belts 234,262, each one of the drive pulleys, not shown, operatively associated with the first primary and second auxiliary conveyor belts 234,262, is driven by means of its separate drive mechanism which comprises a drive motor 304 and a gear mechanism which is disposed within a gear housing 306 as shown within FIGS. 7–11. As seen in FIGS. 9 and 9*a*, the drive motor 304 for the drive pulley of the second auxiliary conveyor belt 262 has a dependent drive shaft disposed within a drive shaft housing 308, and the motor drive shaft is operatively engaged with a gear drive disposed within the gear housing 306. The output from the gear drive within the gear housing 306 comprises a gear coupling 310 which operatively connects the gear drive to the conveyor drive pulley, not shown. As has been noted, the structural components for the first primary conveyor belt 234 are substantially the same as those for the second auxiliary conveyor belt 262, except that for spatial accommodation reasons, the orientation of some of the components may be somewhat different, as can be seen, for example, from FIGS. 7 and 8, wherein the axis of the drive motor 304 for the second auxiliary conveyor belt 262 is substantially vertical while the axis of the drive motor 304 for the first primary conveyor belt 234 is substantially horizontal.

Figure 10:
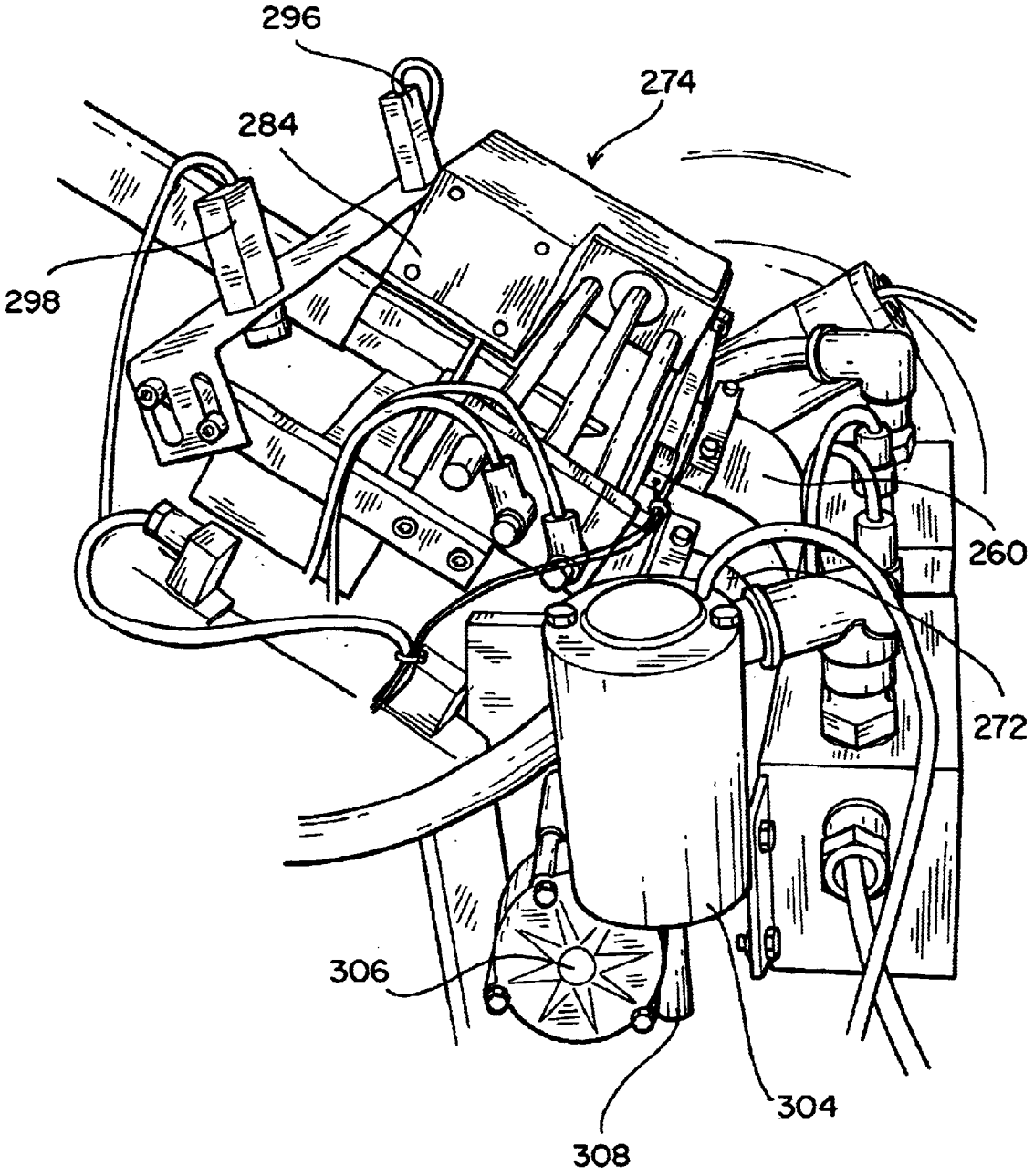
FIG. 10 is an enlarged, side elevational view of the internal components of the new and improved temporary raised pavement marker (TRPM) applicator apparatus or machine as illustrated within FIG. 8 showing further details of the pavement marker slide mechanism and the photodetectors operatively associated with the primary and secondary conveyors.
Figure 11:
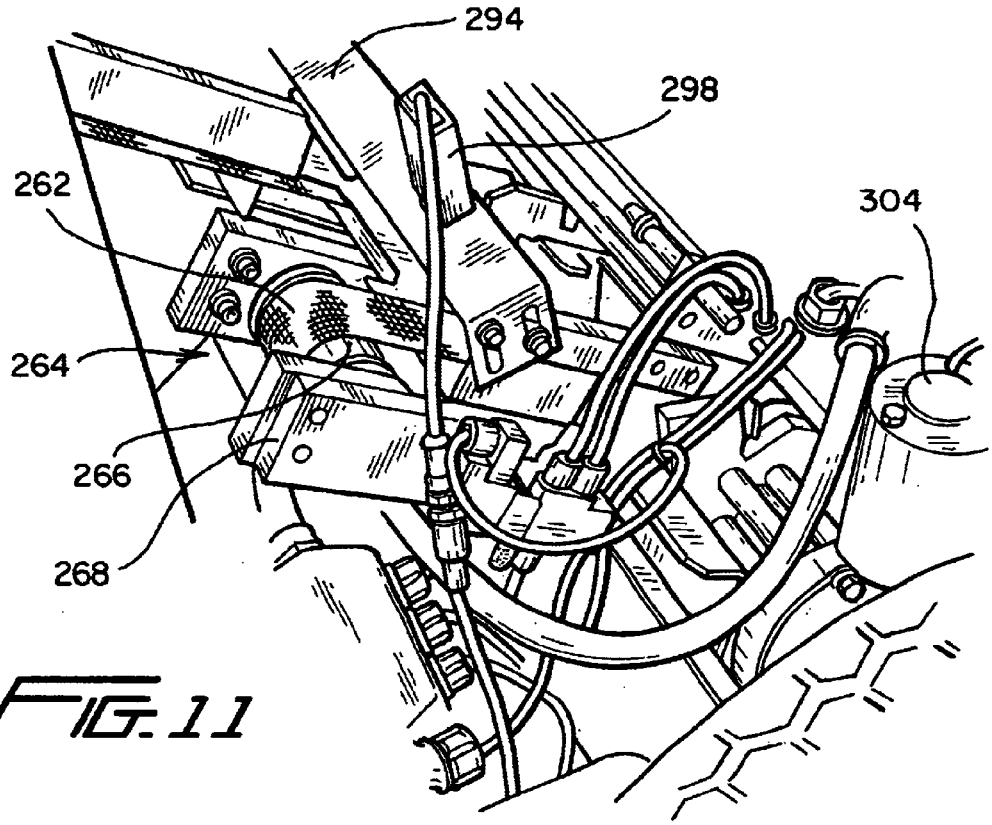
FIG. 11 is a left side perspective view of that region of the machine or apparatus as illustrated within FIG. 9 showing the operative connection of the drive motor and the gear assembly to the secondary conveyor.
Figure 16A:
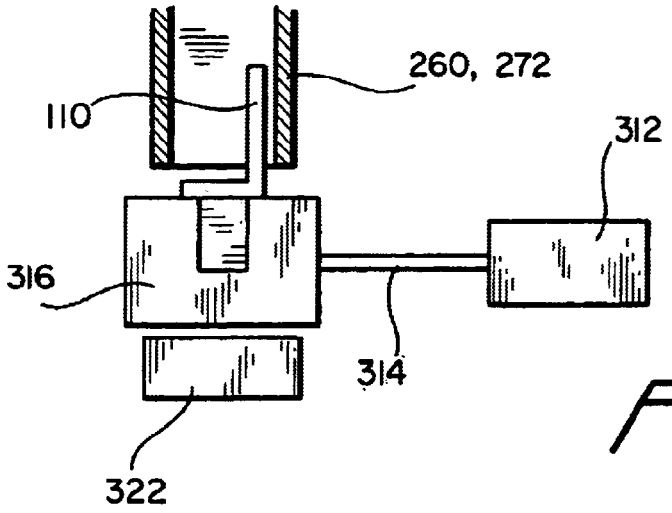
FIGS. 16*a–c* are schematic drawings illustrating the sequential operations comprising the downward passage of a temporary raised pavement marker (TRPM) through one of the vertically oriented delivery chutes, and the subsequent transfer of the delivered temporary raised pavement marker (TRPM), by one of the transfer piston-cylinder assemblies, from its disposition beneath the delivery chute to its application position beneath the drive ram of the applicator piston-cylinder assembly.
Figure 16B:
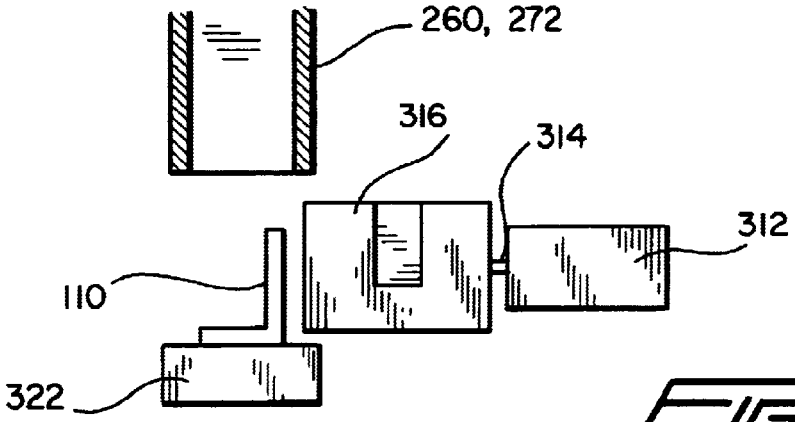

With reference now being made to FIGS. 8, 9, 9*a*, 15, and 16*a*–16*c*, when the temporary raised pavement markers (TRPM) 110 are conveyed into the vertically oriented delivery chutes 260,272, and due the fact that the upper, upstream end portion of each delivery chute 260,272 has an arcuate configuration as may best be appreciated from FIGS. 9*a* and 10, the temporary raised pavement markers (TRPM) 110 are delivered to the lower, downstream end portion of each delivery chute 260,272 in an orientation whereby the normally horizontally disposed leg member 112 of each temporary raised pavement marker (TRPM) 110 is disposed horizontally and extends in the forward direction as schematically illustrated within FIG. 16*a*. A pair of laterally spaced, horizontally disposed, dual-actuated transfer piston-cylinder assemblies 312,312 are each mounted upon a suitable framework 313 operatively associated with the lower, downstream end portion of each delivery chute 260,272, and as best seen in FIG. 16*a*, the piston rod 314 of each piston-cylinder assembly 312 has a substantially U-shaped support plate 316 mounted upon the distal end of the piston rod 314.

When the piston rod 314 of each piston-cylinder assembly 312 is extended, the support plate 316 is positioned beneath the lower open end of its operatively associated delivery chute 260,272 such that the particular temporary raised pavement marker (TRPM) 110 that has been delivered to the bottom or lower end portion of the delivery chute 260, 272 will be seated atop the support plate 316. The support plate 316 is provided with its U-shaped configuration so as to minimize adhesion of the adhesive pad 118 of the temporary raised pavement marker (TRPM) 110 to the support plate 316, and in order to further minimize such adhesion, the support plate 316 can be fabricated from or coated with any suitable material exhibiting non-stick properties, such as, for example, MAGNAPLATE®.

Figure 16C:
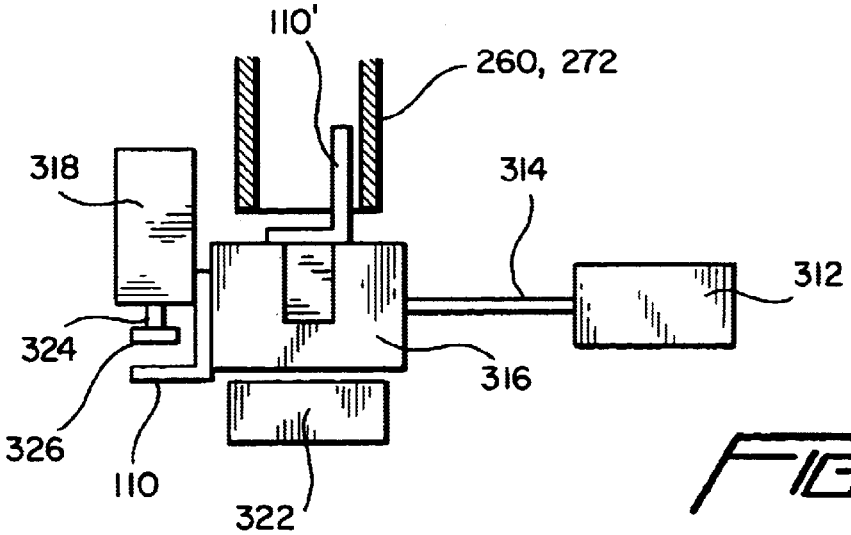

In order to actually apply or bond each temporary raised pavement marker (TRPM) 110 to the roadway surface 220 by means of its adhesive pad 118, an applicator piston-cylinder assembly 318 is disposed in front of each delivery chute 260,272 as shown in FIGS. 9, 9*a*, and 16*c*, although only the applicator piston-cylinder assembly 318 operatively associated with the delivery chute 272 is actually visible. In addition to the provision of the transfer assemblies 312 and the applicator assemblies 318, a pair of photodetectors 320,320 are respectively operatively associated with the lower end portions of the delivery chutes 260,272 so as to detect the presence of the temporary raised pavement markers (TRPM) 110 at positions within the bottom or lower end portions of the delivery chutes 260,272 and atop the support plates 316 of the transfer assemblies 312 as a result of the temporary raised pavement markers (TRPM) 110 traversing the delivery chutes 260,272 after being discharged into the delivery chutes 260,272 from the first primary and second auxiliary conveyor belts 234,262.

The photodetectors 320,320 are operatively connected to the program logic controller (PLC) 300, and therefore, when the photodetectors 320,320 detect the presence of the temporary raised pavement markers (TRPM) 110 at their positions within the bottom or lower end portions of the delivery chutes 260,272 and atop the support plates 316 of the transfer assemblies 312, signals are generated and transmitted to the program logic controller (PLC) 300. Accordingly, the program logic controller (PLC) 300 will generate appropriate control signals for actuating the transfer assemblies 312 whereby the piston rods 314 and the attached support plates 316 are moved to their retracted positions as illustrated within FIG. 16*b*.

A transfer rail 322 is fixedly disposed beneath each one of the delivery chutes 260,272 such that the support plates 316 of the transfer assemblies 312 are interposed between the transfer rails 322 and the delivery chutes 260,272 when the piston rods 314 and the support plates 316 are disposed at their extended positions. When the piston rods 314 and the attached support plates 316 are therefore moved to their retracted positions as illustrated within FIG. 16*b*, the temporary raised pavement markers (TRPM) 110 drop downwardly onto the transfer rails 322 and are now ready to be moved toward the applicator assemblies 318. Accordingly, when the transfer assemblies 312 are subsequently actuated whereby the piston rods 314 and the support plates 316 are moved to their extended positions as shown in FIG. 16*c*, the vertical leg members 114 of the temporary raised pavement markers (TRPM) 110 will effectively be trapped between the support plates 316 and the applicator assemblies 318. At the same time that the piston rods 314 and the support plates 316 are moved to their extended positions as illustrated in FIG. 16*c*, the program logic controller (PLC) 300 will also generate a signal so as to actuate the conveyor belt drive motors 304 whereby the primary and auxiliary conveyor belts 234,262 will advance other temporary raised pavement markers (TRPM) 110' into the delivery chutes 260, 272 so as to be placed atop the support plates 316. Lastly, the program logic controller (PLC) 300 generates another control signal so as to cause the actuation or firing of the applicator assemblies 318 whereby the piston rods 324 thereof, which have ram members 326 fixedly mounted upon the distal ends thereof, are extended such that the ram members 326 engage the horizontal leg members 112 of the temporary raised pavement markers (TRPM) 110 and force the same into engagement with the roadway surface 220 whereby the temporary raised pavement markers (TRPM) 110 will be adhesively bonded to the roadway surface 220. Simultaneously with the actuation or firing of the applicator assemblies 318, the program logic controller (PLC) 300 also causes the transfer assemblies 312 to be retracted thereby permitting the subsequently advanced temporary raised pavement markers (TRPM) 110', which were disposed atop the support plates 316, to drop down onto each transfer rail 322. The cyclic operations are then repeated in order to successively apply a plurality of temporary raised pavement markers (TRPM) 110 onto the roadway surface 220.

Figure 17:
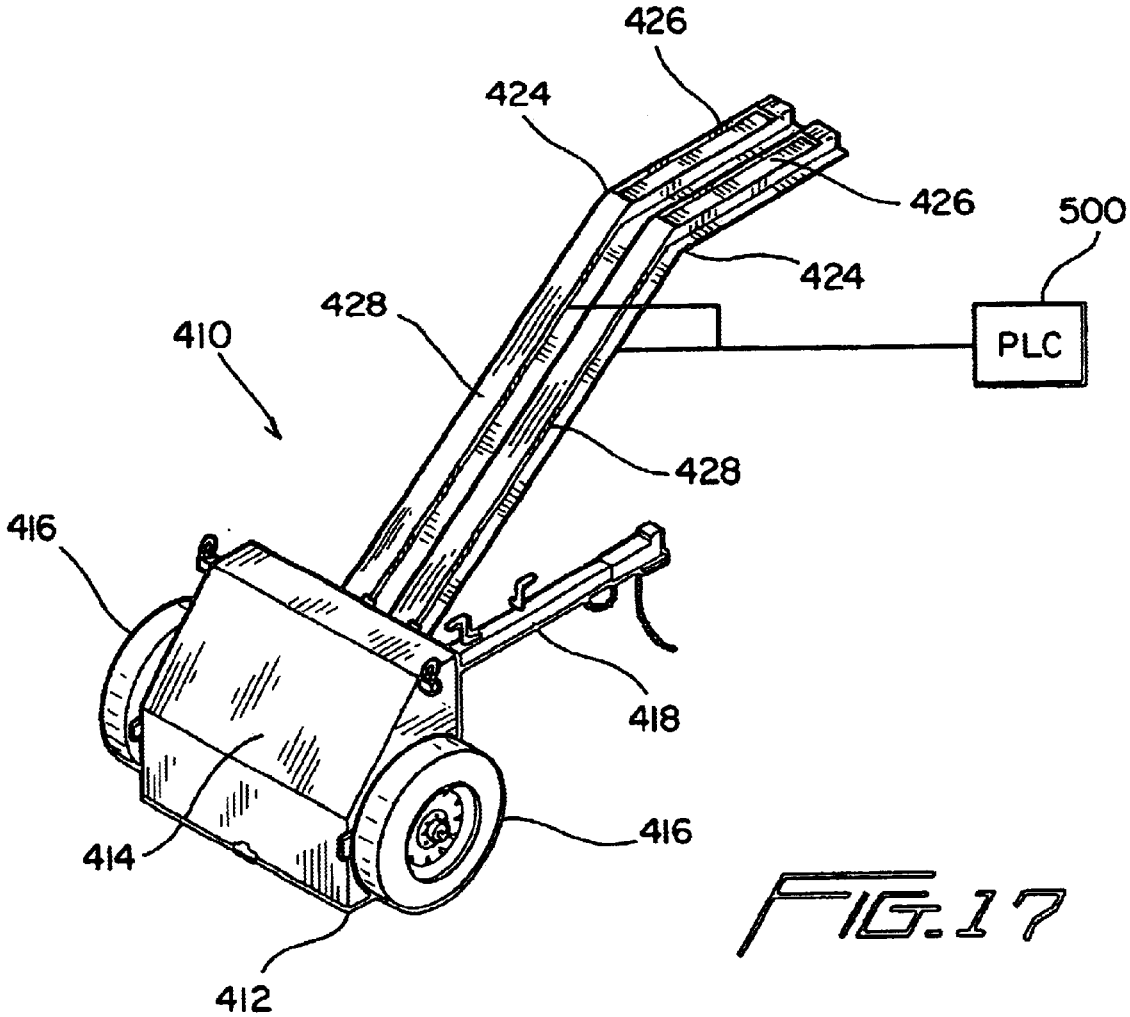
FIG. 17 is a perspective view of a second embodiment of a new and improved machine or apparatus constructed in accordance with the principles and teachings of the present invention and showing the cooperative parts thereof for applying temporary raised pavement markers (TRPMs) onto roadway surfaces.
Figure 2:
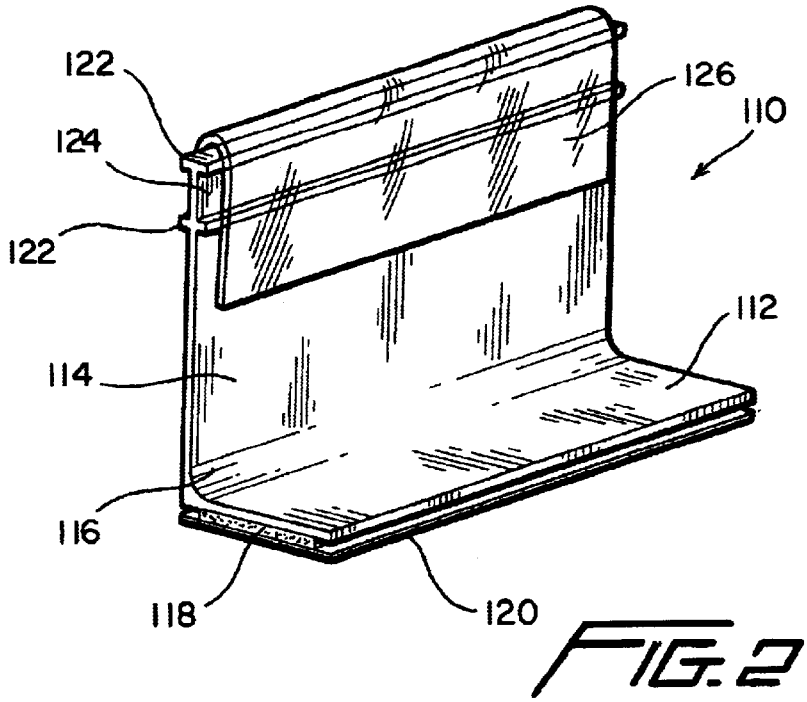
FIG. 2 is a perspective view of a temporary raised pavement marker (TRPM) of the type which is adapted to be applied to a roadway surface, by means of the device, machine, or apparatus constructed in accordance with the principles and teachings of the present invention, in order to desirably define or delineate simulated roadway traffic lines.
Figure 19:
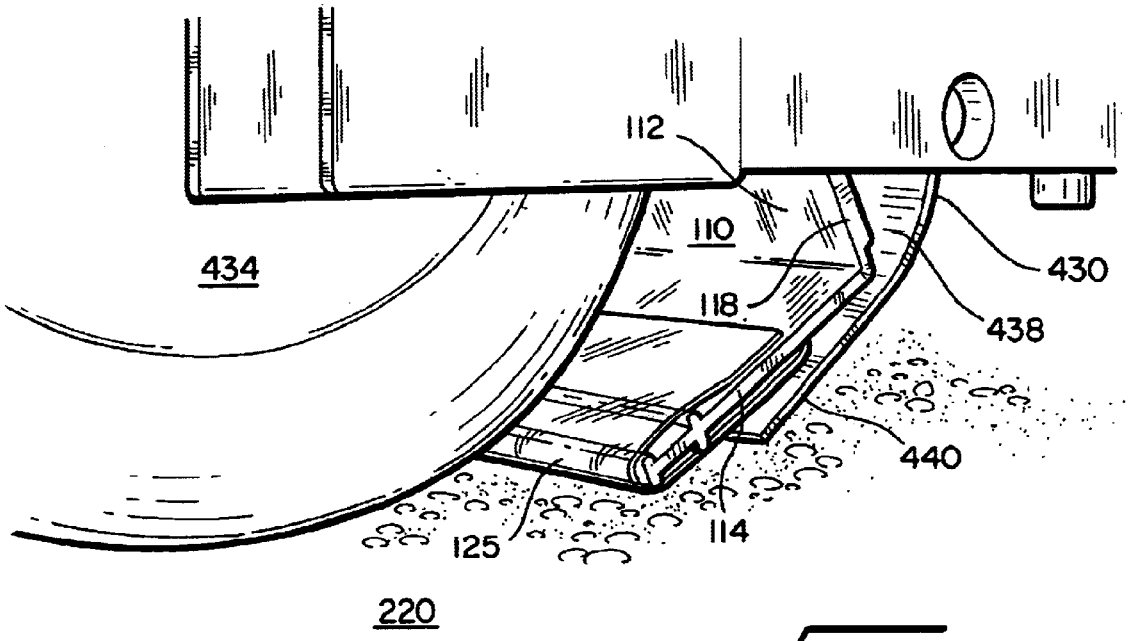
FIG. 19 is a close-up detailed side elevational view showing the beginning of the application operation as being performed upon a temporary raised pavement marker (TRPM) as the same is being applied onto a roadway surface.
Figure 18:
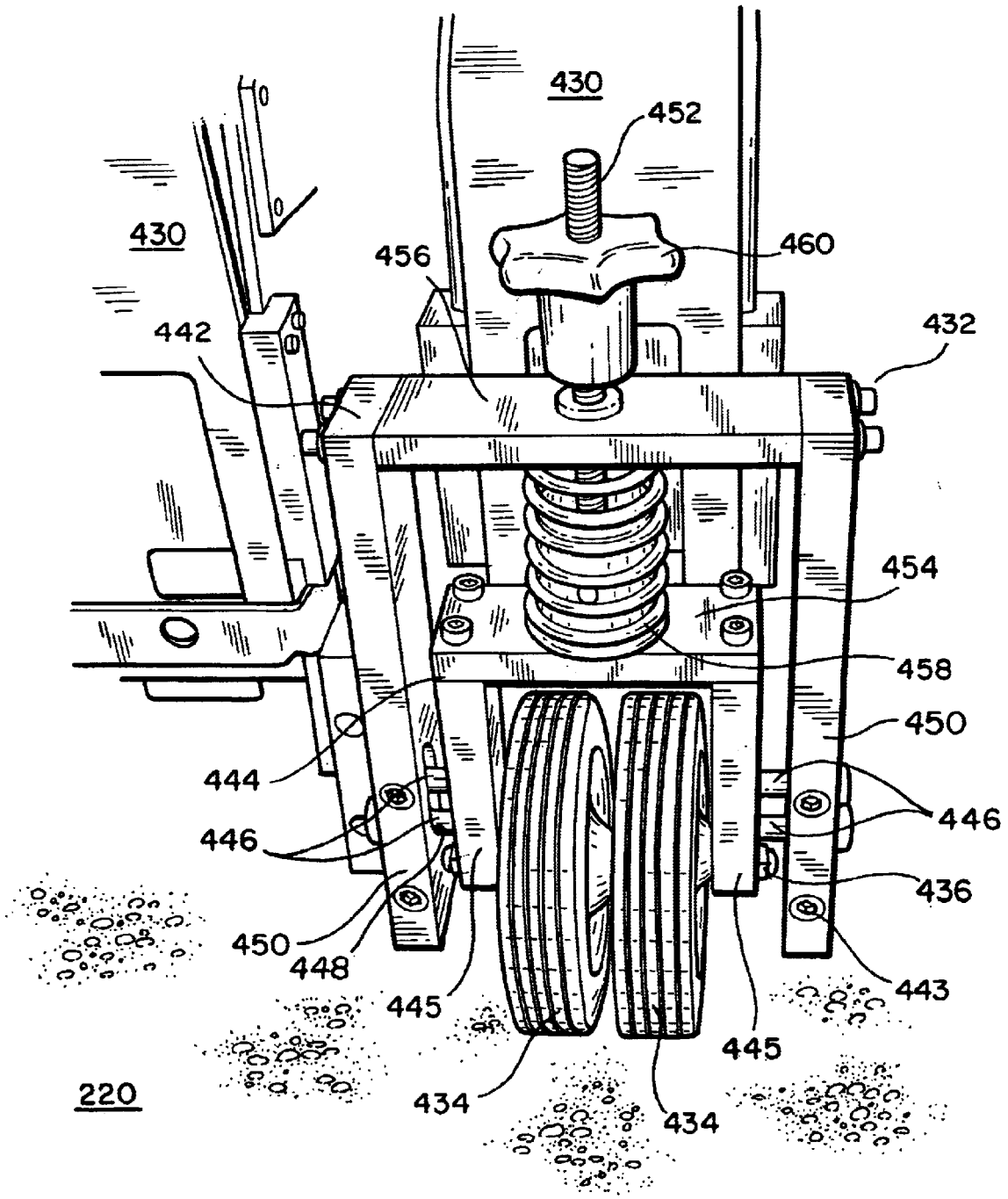
FIG. 18 is a rear elevational view showing the details of one of the wheel applicator assemblies used within the machine or apparatus disclosed within FIG. 17 for applying the temporary raised pavement markers (TRPMs) onto the roadway surfaces.

Referring now to FIGS. 17–19, a second embodiment of a new and improved apparatus or machine for automatically applying temporary raised pavement markers (TRPMs) to roadway surfaces, as also constructed in accordance with the principles and teachings of the present invention, is disclosed and is generally indicated by the reference character 410. It is to be noted that, in connection with those components of the second embodiment of the new and improved apparatus or machine 410 of the present invention for automatically applying temporary raised pavement markers (TRPMs) to roadway surfaces, which correspond to similar components of the first embodiment of the new and improved apparatus or machine 210 of the present invention for automatically applying temporary raised pavement markers (TRPMs) to roadway surfaces, such components will be designated by similar reference characters except that they will be within the 400 series. Accordingly, it is seen, for example, that the new and improved apparatus or machine 410 of the present invention for automatically applying temporary raised pavement markers (TRPMS) to roadway surfaces comprises a wheeled vehicle 412 which includes a central housing 414 that is adapted to be rollably supported upon the roadway surface by means of pair of laterally spaced wheel assemblies 416. In addition, a trailer hitch assembly 418 permits the machine or apparatus 410 to be operatively connected to a roadwork service vehicle or truck, similar to that disclosed at 222 within FIG. 3, so as to be pulled along the roadway surface by means of the roadwork service vehicle or truck 222.

As may readily be recalled in connection with the first embodiment of the new and improved machine or apparatus 210 for automatically applying temporary raised pavement markers (TRPMs) to roadway surfaces, the machine or apparatus 210 comprised a first primary upstream conveyor 224 and a second auxiliary downstream conveyor 264, however, contrary to such a structural arrangement, and in accordance with the second embodiment of the new and improved apparatus or machine 410 for automatically applying temporary raised pavement markers (TRPMS) to roadway surfaces, the use of primary and secondary conveyors 224,264 has been eliminated, and in lieu thereof, there is provided a pair of laterally spaced conveyors 424 each one of which is substantially similar to the primary conveyor 224 of the first embodiment of the new and improved machine or apparatus 210 for automatically applying temporary raised pavement markers (TRPMs) to roadway surfaces. More particularly, as was the case with the primary conveyor 224, each one of the conveyors 424 comprises an upstream, horizontally disposed section 426, and a downstream, downwardly inclined section 428 wherein, again, as was the case with the primary conveyor 224, when the wheeled vehicle portion 412 of the apparatus or machine 410 is operatively connected to the roadwork service vehicle or truck 222 by means of the trailer hitch assembly 418, an upstream end portion of each upstream, horizontally disposed section 426 of each conveyor 424 will be disposed above the rear end section of the roadwork service vehicle or truck 222 such that an operator or workman, who is stationed within or upon the rear end section of the roadwork service truck or vehicle 222, can serially load temporary raised pavement markers (TRPMs) 110 onto the upstream, horizontally disposed section 426 of each conveyor 424.

In view of the fact that each conveyor 424 is substantially similar to the primary conveyor 224 of the first embodiment of the new and improved machine or apparatus 210, further details of each conveyor 424 will be omitted herefrom in the interest of brevity, however, it is noted that each conveyor 424 is of course provided with its own drive motor, not shown but similar to, for example, the drive motor 304 as disclosed in conjunction with the first embodiment of the new and improved machine or apparatus 210, and the activation and control of such drive motors, not shown, are under the control of a program logic controller (PLC) 500 which is similar to the program logic controller (PLC) 300 of the first embodiment of the new and improved machine or apparatus 210. Still further, in view of the effective elimination of the combination of the relatively long primary conveyor 224 and the relatively short secondary conveyor 264 of the first embodiment of the new and improved machine or apparatus 210, and the replacement of the same by means of the pair of conveyors 424,424 of the second embodiment of the new and improved machine or apparatus 410, the slide transfer mechanism 274 of the first embodiment of the new and improved machine or apparatus 210 has likewise been eliminated, and therefore, in accordance with the structural arrangement which is further characteristic of the second embodiment of the new and improved machine or apparatus 410 of the present invention, it is specifically noted from FIG. 18 that the downstream end portion of each one of the downwardly inclined conveyor sections 428,428 is adapted to be operatively connected to an upstream end portion of a vertically oriented chute member 430,430 each one of which is substantially similar to the chute members 260,272.

In addition, the transfer and applicator assemblies 312, 318 of the first embodiment of the new and improved machine or apparatus 210 of the present invention have also been eliminated, and in lieu thereof, a pair of laterally spaced wheel applicator assemblies 432, only one of which is actually shown in FIG. 18, is adapted to be operatively associated with each one of the vertically oriented chute members 430,430 so as to apply the temporary raised pavement markers (TRPMS) 110 onto the roadway surface 220. Each one of the wheel applicator assemblies 432 comprises a pair of applicator wheels 434,434 which are rotatably mounted upon a axle 436, and as can best be appreciated from FIG. 19, the applicator wheels 434, only one of which is partially shown in FIG. 19, are disposed adjacent the lower end portion of each vertically oriented chute member 430. More particularly, the lower end portion of each vertically oriented chute member 430 is seen to comprise an arcuately configured transitional region 438, and a planar free end portion 440 which is inclined at a predetermined angle with respect to the roadway surface 220 so as to properly discharge each one of the temporary raised pavement markers (TRPMs) 110 out from the vertically oriented chute member 430 and to deposit the same onto the roadway surface 220.

It is specifically noted that when each temporary raised pavement marker (TRPM) 110 is discharged from the vertically oriented chute member 430 and deposited onto the roadway surface 220, the normally vertically oriented leg member 114 of the temporary raised pavement marker (TRPM) 110 is disposed substantially horizontally, while the normally horizontally oriented leg member 112 of the temporary raised pavement marker (TRPM) 110 is disposed vertically. In addition, it is further noted that the upper edge portion 125 of the normally vertically oriented leg member 114 of the temporary raised pavement marker (TRPM) 110 is the part of the temporary raised pavement marker (TRPM) 110 that first encounters the roadway surface 220, and immediately upon encountering the roadway surface 220, the applicator wheels 434,434 encounter the upper edge portion 125 of the horizontally disposed leg member 114 of the temporary raised pavement marker (TRPM) 110 so as to effectively fixedly retain the temporary raised pavement marker (TRPM) 110 at its deposited position upon the roadway surface 220. In this manner, when the applicator wheels 434,434 move forwardly as a result of the wheeled vehicle 412 being pulled along the roadway surface 220 by means of the roadwork service truck or vehicle 222, the applicator wheels 434,434 will roll over the temporary raised pavement marker (TRPM) 110 causing the same attain a substantially flattened state facilitated by means of the transitional region 116 of the temporary raised pavement marker (TRPM) 110 as well as the inherent elasticity characteristic of the temporary raised pavement marker (TRPM) 110. As a result of the temporary raised pavement marker (TRPM) 110 attaining such a flattened state, the adhesive pad 118 will be adhesively bonded to the roadway surface 220, and upon complete passage of the applicator wheels 434,434 beyond the temporary raised pavement marker (TRPM) 110, the inherent resiliency of the temporary raised pavement marker (TRPM) 110 will permit the leg member 114 to attain its normally vertical orientation.

With reference lastly being made to FIG. 18, the details of the mounting of each wheel applicator assembly 432 upon the wheeled vehicle 412 will now be described. The pair of wheel applicator assemblies 432 are adapted to be disposed internally within the central housing 414 of the wheeled vehicle 412, and it is seen that each wheel applicator assembly 432 comprises an outer frame assembly 442 having a substantially inverted U-shaped configuration, and an inner frame assembly 442 likewise having a substantially inverted U-shaped configuration. The outer frame assembly 442 is fixedly secured to suitable support structure, not shown, of the wheeled vehicle 412 by means of bolt fasteners 443, and the axle 436, upon which the applicator wheels 434,434 are mounted, has its opposite ends mounted within side frame members 445,445 of the inner frame assembly 444. A pair of shafts 446,446 extend laterally outwardly from each one of the side frame members 445,445 and are slidably disposed within suitable vertically oriented slots 448, only one of which is shown, which are defined within side frame members 450,450 of the outer frame assembly 442, and in this manner, the inner frame assembly 444 is vertically movable with respect to the outer frame assembly 442 so as to provide limited vertical movement for the applicator wheels 434,434. A vertically oriented externally threaded rod 452 projects upwardly from an upper horizontally disposed frame member 454 of the inner frame assembly 444 so as to extend through an upper horizontally disposed frame member 456 of the outer frame assembly 442.

A coil spring 458, disposed around a lower end portion of the threaded rod 452, is interposed between an undersurface portion of the upper frame member 456 of the outer frame assembly 442 and an upper surface portion of the upper frame member 454 of the inner frame assembly 444, and an adjustment nut 460 is threadedly engaged upon the upper end portion of the threaded rod 452. Accordingly, by operative engagement of the adjustment nut 460 with the threaded rod 452, the disposition of the inner frame assembly 444, and therefore the disposition of the applicator wheels 434, 434, with respect to the outer frame assembly 442 and the roadway surface 220, may be achieved. In this manner, the applicator wheels 434,434, through means of their mounting upon the inner frame assembly 444, are always properly engaged with the roadway surface 220 in a spring-biased, shock-absorber manner so as to accommodate any irregularities in the roadway surface 220 as well as to accommodate the rolling movement over the temporary raised pavement markers (TRPMs) 110 when the same are being applied onto the roadway surface 220.

Thus, it may be seen that in accordance with the principles and teachings of a first embodiment of the present invention, there has been disclosed new and improved apparatus for automatically applying temporary raised pavement markers (TRPM) to roadway surfaces which comprises a conveyor for serially feeding a plurality of temporary raised pavement markers (TRPM) toward a vertically oriented delivery chute, a transfer piston-cylinder assembly disposed at the downstream end of the delivery chute for receiving each delivered temporary raised pavement marker (TRPM) and transferring the same to an applicator piston-cylinder assembly, and an applicator ram disposed upon the applicator assembly piston rod for applying the temporary raised pavement marker (TRPM) to the roadway surface. In accordance with a second embodiment of the invention, wheel applicators are utilized to apply the temporary raised pavement markers (TRPMs) to the roadway surface.

Obviously, many variations and modifications of the present invention are possible in light of the above teachings. For example, while the invention has been disclosed, for example, in connection with the simultaneous application of a dual set of temporary raised pavement markers (TRPM) to the roadway surface, the program logic controller (PLC) of the first embodiment of the apparatus can be suitably programmed whereby the apparatus can be utilized to apply only a single temporary raised pavement marker (TRPM) to the roadway surface so as to effectively form only a single line of temporary raised pavement markers (TRPM). In particular, the program logic controller (PLC) of the apparatus can be suitably programmed so as to operationally disable or override the photodetector 298 and the operation of the slide mechanism 284. The temporary raised pavement markers (TRPM) 110 may therefore be simply conveyed along primary conveyor 224 in a serially indexed manner so as to effectively form only a single line of temporary raised pavement markers (TRPM) 110. In a similar manner, in connection with the second embodiment of the invention, the program logic controller (PLC) can likewise operationally control only one of the conveyors 424 while effectively disabling the other one of the conveyors 424 so as to again achieve the deposition of the temporary raised pavement markers (TRPMs) within only a single line of markers. It is therefore to be understood further that within the scope of the appended claims, the present invention may be practiced otherwise than as specifically described herein.

What is claimed as new and desired to be protected by Letters Patent of the United States of America, is:

1. Apparatus for automatically serially applying a plurality of pavement markers to a roadway surface as a result of said apparatus being attached to a roadwork vehicle and thereby moving along the roadway surface with the roadwork vehicle, comprising:

a first primary conveyor comprising upstream end means, disposed at an upper elevational level so as to be accessible by an operator disposed upon the roadwork vehicle, for permitting a plurality of pavement markers to be serially placed upon said upstream end means of said first primary conveyor by the operator disposed upon the roadwork vehicle, a first primary conveyor belt movably mounted upon said first primary conveyor and having a plurality of carrier elements fixedly disposed upon said first primary conveyor belt for respectively seating the plurality of pavement markers thereon so as to convey the plurality of pavement markers along said first primary conveyor from said upstream end means to a downstream end portion of said first primary conveyor disposed at a lower elevational level closer to the roadway surface so as to enable the plurality of pavement markers to be applied to the roadway surface, and a first primary conveyor belt drive mechanism for moving said first primary conveyor belt along said first primary conveyor;

a first applicator mechanism for operatively engaging individual ones of the plurality of pavement markers so as to serially apply the plurality of pavement markers to the roadway surface; and a first transfer mechanism for transferring individual ones of the plurality of pavement markers, conveyed by said first primary conveyor belt to said downstream end portion of said first primary conveyor, from a position disposed beneath said downstream end portion of said first primary conveyor to said first applicator mechanism, whereupon actuation of said first applicator mechanism, the plurality of pavement markers can be serially applied to the roadway surface.

2. The apparatus as set forth in claim 1, wherein:

said upstream end means of said first primary conveyor comprises a horizontally disposed section which is adapted to extend over a rear bed section of the roadwork vehicle so as to be accessible to the operator disposed upon the rear bed section of the roadwork vehicle and thereby facilitate the serial placement of the plurality of pavement markers upon said first primary conveyor; and a remaining portion of said first primary conveyor comprises a downwardly inclined section, integrally connected to said horizontally disposed section, for conveying the plurality of pavement markers downwardly toward the roadway surface so as to be applied to the roadway surface by said first applicator mechanism.

3. The apparatus as set forth in claim 2, wherein:

said first transfer mechanism comprises a first piston-cylinder assembly; and said first applicator mechanism comprises a second piston-cylinder assembly.

4. The apparatus as set forth in claim 3, further comprising:

a first vertically oriented delivery chute operatively connected to said downstream end portion of said first primary conveyor for serially delivering the plurality of pavement markers to said first transfer mechanism.

5. The apparatus as set forth in claim 4, further comprising:

a first photodetector operatively associated with a lower end portion of said first vertically oriented delivery chute for generating a first signal when the presence of a pavement marker at said lower end portion of said first vertically oriented chute is detected; and a program logic controller (PLC) operatively connected to said first photodetector, said first primary conveyor belt drive mechanism, said first transfer mechanism, and said first applicator mechanism, for receiving said first signal from said first photodetector and for generating second control signals to said first primary conveyor belt drive mechanism, said first transfer mechanism, and said first applicator mechanism for respectively actuating said first transfer mechanism so as to transfer a pavement marker to said first applicator mechanism, for actuating said first applicator mechanism so as to apply the pavement marker to the roadway surface, and for actuating said first primary conveyor belt drive mechanism so as to advance a successive pavement marker toward said first vertically oriented delivery chute for delivery to said first transfer mechanism.

6. The apparatus as set forth in claim 5, further comprising:

a second auxiliary conveyor laterally spaced from and disposed substantially parallel to said first primary conveyor, a second auxiliary conveyor belt movably mounted upon said second auxiliary conveyor and having a plurality of carrier elements fixedly disposed upon said second auxiliary conveyor belt for respectively seating a plurality of pavement markers thereon so as to convey the plurality of pavement markers along said second auxiliary conveyor to a downstream end portion of said second auxiliary conveyor so as to enable the plurality of pavement markers to be applied to the roadway surface, and a second auxiliary conveyor belt drive mechanism for moving said second auxiliary conveyor belt along said second auxiliary conveyor; and a slide mechanism laterally movable between said first primary conveyor belt and said second auxiliary conveyor belt for laterally transferring predetermined ones of the plurality of pavement markers, disposed upon said first primary conveyor belt, onto said second auxiliary conveyor belt.

7. The apparatus as set forth in claim 6, further comprising:

a second applicator mechanism for operatively engaging individual ones of the plurality of pavement markers previously conveyed along said second auxiliary conveyor belt so as to serially apply the plurality of pavement markers to the roadway surface; and a second transfer mechanism for transferring individual ones of the plurality of pavement markers, conveyed by said second auxiliary conveyor belt to said downstream end portion of said second auxiliary conveyor, from a position disposed beneath said downstream end portion of said second auxiliary conveyor to said second applicator mechanism whereupon actuation of said second applicator mechanism, the plurality of pavement markers can be serially applied to the roadway surface.

8. The apparatus as set forth in claim 7, further comprising:

a second vertically oriented delivery chute operatively connected to said downstream end portion of said second auxiliary conveyor for serially delivering the plurality of pavement markers conveyed along said second auxiliary conveyor belt to said second transfer mechanism.

9. The apparatus as set forth in claim 8, further comprising:

a second photodetector operatively associated with a lower end portion of said second vertically oriented delivery chute for generating a third signal when the presence of a pavement marker at said lower end portion of said second vertically oriented chute is detected;

said program logic controller (PLC) being operatively connected to said second photodetector, said second auxiliary conveyor belt drive mechanism, said second transfer mechanism, and said second applicator mechanism, for receiving said third signal from said second photodetector and for generating fourth control signals to said second auxiliary conveyor belt drive mechanism, said second transfer mechanism, and said second applicator mechanism for respectively actuating said second transfer mechanism so as to transfer a pavement marker to said second applicator mechanism, for actuating said second auxiliary conveyor belt drive mechanism so as to advance a successive pavement marker toward said second vertically oriented delivery chute for delivery to said second transfer mechanism, and for actuating said second applicator mechanism so as to apply the pavement marker to the roadway surface.

10. The apparatus as set forth in claim 9, further comprising:

third and fourth photodetectors respectively operatively associated with said first primary and second auxiliary conveyor belts for detecting the presence and absence of pavement markers upon said first primary and second auxiliary conveyor belts, and operatively connected to said program logic controller (PLC) so as to generate signals indicative of the presence and absence of a pavement markers upon said first primary and second auxiliary conveyor belts;

said program logic controller (PLC) being operatively connected to said slide mechanism for causing said slide mechanism to transfer a pavement marker from said first primary conveyor belt to said second auxiliary conveyor belt when the absence of a pavement marker upon said second auxiliary conveyor belt is detected by said fourth photodetector, said program logic controller (PLC) being operatively connected to said first primary conveyor belt drive mechanism for advancing said first primary conveyor belt such that said third photodetector detects the presence of a pavement marker upon said first primary conveyor belt, and said program logic controller (PLC) being operatively connected to said first primary and second auxiliary conveyor belt drive mechanisms for advancing said first primary and second auxiliary conveyor belts when both said third and fourth photodetectors detect the presence of pavement markers upon said first primary and second auxiliary conveyor belts.

11. In combination, apparatus for automatically serially applying a plurality of pavement markers to a roadway surface as a result of said apparatus being attached to a roadwork vehicle and thereby moving along the roadway surface with said roadwork vehicle, comprising:

a roadwork vehicle;

a housing;

hitch means operatively connecting said housing to said roadwork vehicle;

a first primary conveyor mounted upon said housing and comprising upstream end means, disposed at an upper elevational level so as to be accessible by an operator disposed upon said roadwork vehicle, for permitting a plurality of pavement markers to be serially placed upon said upstream end means of said first primary conveyor by the operator disposed upon said roadwork vehicle, a first primary conveyor belt movably mounted upon said first primary conveyor and having a plurality of carrier elements fixedly disposed upon said first primary conveyor belt for respectively seating the pluality of pavement markers thereon so as to convey the plurality of pavement markers along said first primary conveyor from said upstream end means to a downstream end portion of said first primary conveyor disposed at a lower elevational level closer to the roadway surface so as to enable the plurality of pavement markers to be applied to the roadway surface, and a first primary conveyor belt drive mechanism for moving said first primary conveyor belt along said first primary conveyor;

a first applicator mechanism for operatively engaging individual ones of the plurality of pavement markers so as to serially apply the plurality of pavement markers to the roadway surface; and a first transfer mechanism for transferring individual ones of the plurality of pavement markers, conveyed by said first primary conveyor belt to said downstream end portion of said first primary conveyor, from a position disposed beneath said downstream end portion of said first primary conveyor to said first applicator mechanism whereupon actuation of said first applicator mechanism, the plurality of pavement markers can be serially applied to the roadway surface.

12. The combination as set forth in claim 11, wherein:

said upstream end means of said first primary conveyor comprises a horizontally disposed section which is adapted to extend over a rear bed section of said roadwork vehicle so as to be accessible to the operator disposed upon the rear bed section of said roadwork vehicle and thereby facilitate the serial placement of the plurality of pavement markers upon said first primary conveyor; and a remaining portion of said first primary conveyor comprises a downwardly inclined section, integrally connected to said horizontally disposed section, for conveying the plurality of pavement markers downwardly toward the roadway surface so as to be applied to the roadway surface by said first applicator mechanism.

13. The combination as set forth in claim 12, wherein:

said first transfer mechanism comprises a first piston-cylinder assembly; and said first applicator mechanism comprises a second piston-cylinder assembly.

14. The combination as set forth in claim 13, further comprising:

a first vertically oriented delivery chute operatively connected to said downstream end portion of said first primary conveyor for serially delivering the plurality of pavement markers to said first transfer mechanism.

15. The combination as set forth in claim 14, further comprising:

a first photodetector operatively associated with a lower end portion of said first vertically oriented delivery chute for generating a first signal when the presence of a pavement marker at said lower end portion of said first vertically oriented chute is detected; and a program logic controller (PLC) operatively connected to said first photodetector, said first primary conveyor belt drive mechanism, said first transfer mechanism, and said first applicator mechanism, for receiving said first signal from said first photodetector and for generating second control signals to said first primary conveyor belt drive mechanism, said first transfer mechanism, and said first applicator mechanism for respectively actuating said first transfer mechanism so as to transfer a pavement marker to said first applicator mechanism, for actuating said first applicator mechanism so as to apply the pavement marker to the roadway surface, and for actuating said first primary conveyor belt drive mechanism so as to advance a successive pavement marker toward said first vertically oriented delivery chute for delivery to said first transfer mechanism.

16. The combination as set forth in claim 15, further comprising:

a second auxiliary conveyor laterally spaced from and disposed substantially parallel to said first primary conveyor, a second auxiliary conveyor belt movably mounted upon said second auxiliary conveyor and having a plurality of carrier elements fixedly disposed upon said second auxiliary conveyor belt for respectively seating a plurality of pavement markers thereon so as to convey the plurality of pavement markers along said second auxiliary conveyor to a downstream end portion of said second auxiliary conveyor so as to enable the plurality of pavement markers to be applied to the roadway surface, and a second auxiliary conveyor belt drive mechanism for moving said second auxiliary conveyor belt along said second auxiliary conveyor; and a slide mechanism laterally movable between said first primary conveyor belt and said second auxiliary conveyor belt for laterally transferring predetermined ones of the plurality of pavement markers, disposed upon said first primary conveyor belt, onto said second auxiliary conveyor belt.

17. The combination as set forth in claim 16, further comprising:

a second applicator mechanism for operatively engaging individual ones of the plurality of pavement markers previously conveyed along said second auxiliary conveyor belt so as to serially apply the plurality of pavement markers to the roadway surface; and a second transfer mechanism for transferring individual ones of the plurality of pavement markers, conveyed by said second auxiliary conveyor belt to said downstream end portion of said second auxiliary conveyor, from a position disposed beneath said downstream end portion of said second auxiliary conveyor to said second applicator mechanism whereupon actuation of said second applicator mechanism, the plurality of pavement markers can be serially applied to the roadway surface.

18. The combination as set forth in claim 17, further comprising:

a second vertically oriented delivery chute operatively connected to said downstream end portion of said second auxiliary conveyor for serially delivering the plurality of pavement markers conveyed along said second auxiliary conveyor belt to said second transfer mechanism.

19. The combination as set forth in claim 18, further comprising:

a second photodetector operatively associated with a lower end portion of said second vertically oriented delivery chute for generating a third signal when the presence of a pavement marker at said lower end portion of said second vertically oriented chute is detected;

said program logic controller (PLC) being operatively connected to said second photodetector, said second auxiliary conveyor belt drive mechanism, said second transfer mechanism, and said second applicator mechanism, for receiving said third signal from said second photodetector and for generating fourth control signals to said second auxiliary conveyor belt drive mechanism, said second transfer mechanism, and said second applicator mechanism for respectively actuating said second transfer mechanism so as to transfer a pavement marker to said second applicator mechanism, for actuating said second auxiliary conveyor belt drive mechanism so as to advance a successive pavement marker toward said second vertically oriented delivery chute for delivery to said second transfer mechanism, and for actuating said second applicator mechanism so as to apply the pavement marker to the roadway surface.

20. The combination as set forth in claim 19, further comprising:

third and fourth photodetectors respectively operatively associated with said first primary and second auxiliary conveyor belts for detecting the presence and absence of pavement markers upon said first primary and second auxiliary conveyor belts, and operatively connected to said program logic controller (PLC) so as to generate signals indicative of the presence and absence of a pavement markers upon said first primary and second auxiliary conveyor belts;

said program logic controller (PLC) being operatively connected to said slide mechanism for causing said slide mechanism to transfer a pavement marker from said first primary conveyor belt to said second auxiliary conveyor belt when the absence of a pavement marker upon said second auxiliary conveyor belt is detected by said fourth photodetector, said program logic controller (PLC) being operatively connected to said first primary conveyor belt drive mechanism for advancing said first primary conveyor belt such that said third photodetector detects the presence of a pavement marker upon said first primary conveyor belt, and said program logic controller (PLC) being operatively connected to said first primary and second auxiliary conveyor belt drive mechanisms for advancing said first primary and second auxiliary conveyor belts when both said third and fourth photodetectors detect the presence of pavement markers upon said first primary and second auxiliary conveyor belts.

21. A method of automatically applying pavement markers to a roadway surface, comprising the steps of:

providing a first primary conveyor with an upstream end portion disposed at an upper elevational level such that said upstream end portion of said first primary conveyor is accessible to an operator disposed within a roadwork vehicle;

depositing a plurality of pavement markers upon said upstream end portion of a first primary conveyor;

conveying the plurality of pavement markers along said first primary conveyor to a downstream end portion of said first primary conveyor which is disposed at a lower elevational level closer to the roadway surface so as to enable the plurality of pavement markers to be applied to the roadway surface;

actuating a first transfer mechanism for transferring individual ones of the plurality of pavement markers, conveyed by said first primary conveyor to said downstream end portion of said first primary conveyor, from a position disposed beneath said downstream end portion of said first primary conveyor to a first application station; and actuating a first applicator mechanism, disposed at said first application station, so as to operatively engage individual ones of the plurality of pavement markers disposed at said first application station and thereby serially apply the plurality of pavement markers to the roadway surface.

22. The method as set forth in claim 21, further comprising the steps of:

providing a second auxiliary conveyor, laterally spaced from and disposed substantially parallel to said first primary conveyor, for conveying a plurality of pavement markers along said second auxiliary conveyor to a downstream end portion of said second auxiliary conveyor so as to enable the plurality of pavement markers to be applied to the roadway surface; and providing a slide mechanism laterally movable between said first primary conveyor and said second auxiliary conveyor for laterally transferring predetermined ones of the plurality of pavement markers, disposed upon said first primary conveyor, onto said second auxiliary conveyor.

23. The method as set forth in claim 22, further comprising the steps of:

actuating a second transfer mechanism for transferring individual ones of the plurality of pavement markers, conveyed by said second primary conveyor to said downstream end portion of said second primary conveyor, from a position disposed beneath said downstream end portion of said second primary conveyor to a second application station; and actuating a second applicator mechanism, disposed at said second application station, so as to operatively engage individual ones of the plurality of pavement markers disposed at said second application station and thereby serially apply the plurality of pavement markers to the roadway surface.

24. Apparatus for automatically serially applying a plurality of pavement markers to a roadway surface, comprising:

means for attaching said apparatus to a roadwork vehicle whereby said apparatus can be moved along the roadway surface as the roadwork vehicle moves along the roadway surface;

at least one conveying means for conveying a plurality of pavement markers from an elevated end portion, which is accessible to personnel disposed within a roadwork vehicle such that the plurality of pavement markers can be deposited upon said at least one conveying means by personnel disposed within the roadwork vehicle, to a lower end portion disposed adjacent to the roadway surface for enabling the deposition of the plurality of pavement markers onto the roadway surface; and means for automatically serially applying the plurality of pavement markers to the roadway surface at predetermined spaced distances defined between the serially applied pavement markers so as to simulate at least one traffic line upon the roadway surface.

25. Apparatus as set forth in claim 1, wherein:

said means for automatically serially applying the plurality of pavement markers to the roadway surface at predetermined spaced distances defined between the serially applied pavement markers comprises a wheel applicator mounted upon said apparatus for encountering and rolling over each one of the plurality of pavement markers deposited onto the roadway surface by said lower end portion of said at least one conveying means so as to apply each one of the pavement markers onto the roadway surface.

26. In combination, apparatus for automatically serially applying a plurality of pavement markers to a roadway surface, comprising:

a roadwork vehicle;

a wheeled vehicle;

hitch means operatively connecting said wheeled vehicle to said roadwork vehicle whereby said wheeled vehicle can be moved along the roadway surface as said roadwork vehicle moves along the roadway surface;

at least one conveying means for conveying a plurality of pavement markers from an elevated end portion, which is accessible to personnel disposed within a roadwork vehicle such that the plurality of pavement markers can be deposited upon said at least one conveying means by personnel disposed within the roadwork vehicle, to a lower end portion disposed adjacent to the roadway surface for enabling the deposition of the plurality of pavement markers onto the roadway surface; and means for automatically serially applying a plurality of pavement markers to the roadway surface at predetermined spaced distances defined between the serially applied pavement markers so as to simulate at least one traffic line upon the roadway surface.

27. The combination as set forth in claim 1, wherein:

said means for automatically serially applying the plurality of pavement markers to the roadway surface at predetermined spaced distances defined between the serially applied pavement markers comprises a wheel applicator mounted upon said wheeled vehicle for encountering and rolling over each one of the plurality of pavement markers deposited onto the roadway surface by said lower end portion of said at least one conveying means so as to apply each one of the pavement markers onto the roadway surface.

28. A method of automatically applying pavement markers to a roadway surface, comprising the steps of:

attaching apparatus, for dispensing a plurality of pavement markers onto a roadway surface, to a roadwork vehicle whereby said apparatus can be moved along the roadway surface as the roadwork vehicle moves along the roadway surface;

depositing a plurality of pavement markers upon an upper end portion of a conveyor which is disposed at an elevated position so as to be accessible to personnel disposed within the roadwork vehicle;

conveying the plurality of pavement markers from said upper end portion of said conveyor to a lower end portion of said conveyor which is disposed adjacent to the roadway surface so as to enable the plurality of pavement markers to be deposited onto the roadway surface; and automatically serially applying the plurality of pavement markers,onto the roadway surface at predetermined spaced distances defined between the serially applied pavement markers, and affixing the plurality of pavement markers to the roadway surface, so as to simulate at least one traffic line upon the roadway surface.

29. The method as set forth in claim 28, further comprising the step of:

using a wheel applicator mounted upon said apparatus for encountering and rolling over each one of the plurality of pavement markers deposited onto the roadway surface at said lower position so as to apply each one of the pavement markers onto the roadway surface.

* * * * *